US006719495B2

(12) United States Patent
Khachaturian

(10) Patent No.: US 6,719,495 B2
(45) Date of Patent: Apr. 13, 2004

(54) ARTICULATED MULTIPLE BUOY MARINE PLATFORM APPARATUS AND METHOD OF INSTALLATION

(76) Inventor: Jon E. Khachaturian, 5427 Sutton Pl., New Orleans, LA (US) 70131

( * ) Notice: Subject to any disclaimer, the term of this patent is extended or adjusted under 35 U.S.C. 154(b) by 0 days.

(21) Appl. No.: 10/293,947

(22) Filed: Nov. 13, 2002

(65) Prior Publication Data

US 2004/0037651 A1 Feb. 26, 2004

Related U.S. Application Data

(63) Continuation-in-part of application No. 10/224,533, filed on Aug. 20, 2002, which is a continuation of application No. 09/704,998, filed on Nov. 2, 2000, now Pat. No. 6,435,773, which is a continuation-in-part of application No. 09/693,470, filed on Oct. 20, 2000, now Pat. No. 6,425,710.

(60) Provisional application No. 60/213,034, filed on Jun. 21, 2000.

(51) Int. Cl.[7] ..... E02D 23/02

(52) U.S. Cl. ..... 405/205; 405/200

(58) Field of Search ..... 405/195.1, 203, 405/205, 206, 224, 200

(56) References Cited

U.S. PATENT DOCUMENTS

| | | | |
|---|---|---|---|
| 2,952,234 | A | 9/1960 | Levinson |
| 3,519,036 | A | 7/1970 | Manning |
| 3,540,396 | A | 11/1970 | Horton |
| 3,708,985 | A | 1/1973 | Pogonowski et al. |
| 3,736,756 | A | 6/1973 | Lloyd |
| 3,977,346 | A | 8/1976 | Natvig et al. |
| 3,982,492 | A | 9/1976 | Steddum |
| 4,007,598 | A | 2/1977 | Tax |
| 4,026,119 | A | 5/1977 | Dotti |
| 4,067,202 | A | 1/1978 | Reed |
| 4,106,146 | A | 8/1978 | Maari |
| 4,155,670 | A | 5/1979 | Stafford |
| 4,249,618 | A | 2/1981 | Lamy |
| 4,286,538 | A | 9/1981 | Matsui |
| 4,297,965 | A | 11/1981 | Horton |
| 4,359,164 | A | 11/1982 | Triplett |
| 4,436,454 | A | 3/1984 | Ninet et al. |
| 4,470,723 | A | 9/1984 | Michel et al. |
| 4,516,882 | A | 5/1985 | Brewer et al. |
| 4,538,939 | A | 9/1985 | Johnson |
| 4,588,328 | A | 5/1986 | Ghilardi et al. |
| 4,620,820 | A | 11/1986 | Collipp |
| 4,674,918 | A | 6/1987 | Kalpins |

(List continued on next page.)

FOREIGN PATENT DOCUMENTS

| | | |
|---|---|---|
| GB | 2092664 | 8/1982 |
| WO | WO 02/35014 | 5/2002 |

OTHER PUBLICATIONS

2000 Worldwide Survey of Deepwater Production Solutions, Offshore Magazine, Sep. 2000.

*Primary Examiner*—Thomas B. Will
*Assistant Examiner*—Raymond W Addie
(74) *Attorney, Agent, or Firm*—Garvey, Smith, Nehrbass & Doody, L.L.C.; Charles C. Garvey, Jr.

(57) ABSTRACT

A marine platform (and method of installation) provides a plurality of buoys, a platform having a peripheral portion that includes a plurality of attachment positions, one attachment position for each buoy, and an articulating connection that connects each buoy to the platform at a respective attachment position, the connection allowing for sea state induced buoy motions while minimizing effect on the platform. A method of installation places the platform (including oil and gas drilling and/or production facility next to the buoys. Ballasting moves the platform and buoys relative to one another until connections are perfected between each buoy and the platform.

72 Claims, 20 Drawing Sheets

U.S. PATENT DOCUMENTS 4,702,321 A 10/1987 Horton
4,708,526 A * 11/1987 Berthet et al. ..... 405/202
4,714,382 A 12/1987 Khachaturian
4,733,991 A 3/1988 Myers
4,913,238 A 4/1990 Danazcko et al.
4,930,924 A 6/1990 Hunt
4,930,938 A 6/1990 Rawstron et al.
4,966,495 A 10/1990 Goldman
5,197,825 A 3/1993 Rasmussen
5,403,124 A 4/1995 Kocaman et al.
5,423,632 A 6/1995 Ekvall et al.
5,439,060 A 8/1995 Huete et al.
5,443,330 A 8/1995 Copple
5,542,783 A 8/1996 Pollack
5,553,977 A 9/1996 Andersen et al.
5,558,467 A 9/1996 Horton
5,706,897 A 1/1998 Horton, III
5,722,797 A 3/1998 Horton, III
5,799,603 A 9/1998 Tellington
5,846,028 A 12/1998 Thory
5,873,416 A 2/1999 Horton, III
5,924,822 A 7/1999 Finn et al.
5,931,602 A 8/1999 Gulbrandsen et al.
6,012,873 A 1/2000 Copple et al.
6,027,286 A 2/2000 Pollack
6,149,350 A 11/2000 Khachaturian
6,171,028 B1 1/2001 Van Gelder
6,425,710 B1 7/2002 Khachaturian
6,435,773 B1 7/2002 Khachaturian
6,435,774 B1 8/2002 Khachaturian
6,471,444 B1 * 10/2002 Pollack ..... 405/203

* cited by examiner

ARTICULATED MULTIPLE BUOY MARINE PLATFORM APPARATUS AND METHOD OF INSTALLATION

CROSS-REFERENCE TO RELATED APPLICATIONS

This is a continuation-in-part of U.S. patent application Ser. No. 10/224,533 filed Aug. 20, 2002, which itself is a continuation of U.S. patent application Ser. No. 09/704,998, filed Nov. 2, 2000(now U.S. Pat. No. 6,435,773), which itself is a continuation-in-part of U.S. patent application Ser. No. 09/693,470, filed Oct. 20, 2000(now U.S. Pat. No. 6,425,710, which itself claimed priority of U.S. Provisional Patent application serial No. 60/213,034, filed Jun. 21, 2000. Priority or each of these applications is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a method of installing a floating marine platform in a deep water environment (over 1500 feet of water). More particularly, the present invention relates to a novel method of installing a marine platform using multiple buoys that support a platform, wherein articulating connections form an interface between the platform and the buoys. In an alternate method, the multiple buoys can be used as part of an installation method to place the marine platform upon a single spar support. The method and apparatus enable transport of the assembled barge, platform and buoys from a shallow water location to a deep water location.

2. General Background of the Invention

Many types of marine platforms have been designed, patented, and/or used commercially. Marine platforms typically take the form of either fixed platforms that include a large underwater support structure or "jacket" or a floating platform having a submersible support. Sometimes these platforms are called semi-submersible rigs.

Jack-up barges are another type of,platform that can be used in an offshore marine environment for drilling/production. Jack-up barges have a barge with long legs that can be powered up for travel and powered down to elevate the barge above the water.

Other types of platforms for deep water (1500 feet or deeper) have been patented. The September 2000 issue of Offshore Magazine shows many floating offshore platforms for use in deep water drilling and/or production. Some of the following patents relate to offshore platforms, some of which are buoy type offshore platforms, all of which are hereby incorporated herein by reference. Other patents have issued that relate in general to floating structures, and include some patents disclosing structures that would not be suitable for use in oil and gas well drilling and/or production.

| PATENT # | ISSUE DATE | TITLE |
|---|---|---|
| 2,952,234 | 09/13/60 | Sectional Floating Marine Platform |
| 3,540,396 | 11/17/70 | Offshore Well Apparatus and System |
| 3,982,492 | 09/1976 | Floating Structure |
| 4,286,538 | 09/01/81 | Multipurpose Floating Structure |
| 4,297,965 | 11/03/81 | Tension leg Structure for Tension Leg Platform |
| 4,620,820 | 11/04/86 | Tension Leg Platform Anchoring Method and Apparatus |
| 5,197,825 | 03/30/93 | Tendon for Anchoring a Semisubmersible Platform |
| 5,423,632 | 06/13/95 | Compliant Platform With Slide Connection Docking to Auxiliary Vessel |
| 5,439,060 | 08/08/95 | Tensioned Riser Deepwater Tower |
| 5,558,467 | 09/24/96 | Deep Water offshore Apparatus |
| 5,706,897 | 01/13/98 | Drilling, Production, Test, and Oil Storage Caisson |
| 5,722,797 | 03/03/98 | Floating Caisson for Offshore Production and Drilling |
| 5,799,603 | 09/01/98 | Shock-Absorbing System for Floating Platform |
| 5,873,416 | 02/23/99 | Drilling, Production, Test, and Oil Storage Caisson |
| 5,931,602 | 08/03/99 | Device for Oil Production at Great Depths at Sea |
| 5,924,822 | 07/20/99 | Method for Deck Installation on an Offshore Substructure |
| 6,012,873 | 01/11/00 | Buoyant Leg Platform With Retractable Gravity Base and Method of Anchoring and Relocating the Same |
| 6,027,286 | 02/22/00 | Offshore Spar Production System and Method for Creating a Controlled Tilt of the Caisson Axis |
| GB 2 092 664 | | Ball-and-Socket Coupling for Use in Anchorage of Floating Bodies |

One of the problems with single floater type marine platform constructions is that the single floater must be enormous, and thus very expensive to manufacture, transport, and install. In a marine environment, such a structure must support an oil and gas well drilling rig or production platform weighing between 5,000 and 40,000 tons, for example (or even a package of between 500–100,000 tons).

BRIEF SUMMARY OF THE INVENTION

The present invention provides an improved offshore marine platform (and method of installation) that can be used for drilling for oil and/or gas or in the production of oil and gas from an offshore environment. Such drilling and/or production facilities typically weigh between 500–100,000 tons, more commonly between 3,000–50,000 tons.

The apparatus of the present invention thus provides a marine platform that is comprised of a plurality of spaced apart buoys and a superstructure having a periphery that includes a plurality of attachment positions, one attachment position for each buoy. An articulating connection joins each buoy to the platform superstructure.

Each of the buoys will move due to current and/or wind and/or wave action or due to other dynamic marine environmental factors. "Articulating connection" as used herein should be understood to mean any connection or joint that connects a buoy to the superstructure, transmits axial and shear forces, and allows the support buoy(s) to move relative to the superstructure without separation, and wherein the bending moment transferred to the superstructure from one of the so connected buoys or from multiple of the so connected buoys is reduced, minimized or substantially eliminated. "Articulating connection" is a joint movably connecting a buoy to a superstructure wherein axial and tangential forces are substantially transmitted, however, transfer of bending moment is substantially reduced or minimized through the joint allowing relative movement between the buoy and the superstructure.

An articulating connection connects each buoy to the platform at a respective attachment position, the connection allowing for sea state induced buoy motions while minimizing effects on the platform.

The apparatus of the present invention provides a marine platform that further comprises a mooring extending from a plurality of the buoys for holding the platform and buoys to a desired location.

In a preferred embodiment, the present invention provides a marine-platform wherein each of the articulating connections includes corresponding concave and convex engaging portions. In another embodiment, a universal type joint is disclosed.

In another embodiment a marine platform has buoys with convex articulating portions and the platform has correspondingly shaped concave articulating portions.

In a preferred embodiment, each buoy can be provided with a concave articulating portion and the platform with a corresponding convex articulating portion that engages a buoy.

In a preferred embodiment, each buoy has a height and a diameter. In a preferred embodiment, the height is much greater than the diameter for each of the buoys.

In the preferred embodiment, each buoy is preferably between about 25 and 100 feet in diameter.

The apparatus of the present invention preferably provides a plurality of buoys, wherein each buoy is between about 100 and 500 feet in height.

The buoys can be of a generally uniform diameter along a majority of the buoy. However, each buoy can have a variable diameter in an alternate embodiment.

In a preferred embodiment, each buoy is generally cylindrically shaped. However, each buoy can be provided with simply an upper end portion that is generally cylindrically shaped.

In a preferred embodiment, there are at least three buoys and at least three attachment positions, preferably four buoys and four attachment positions.

In a preferred embodiment, each articulated connection is preferably hemispherically shaped for the upper end portion of each buoy and there is a correspondingly concavely shaped receptacle on the platform that fits the surface of each hemispherically shaped upper end portion.

In a preferred embodiment, the platform is comprised of a trussed deck. The trussed deck preferably has lower horizontal members, upper horizontal members and a plurality of inclined members spanning between the upper and lower horizontal members, and wherein the attachment positions are next to the lower horizontal member.

In the preferred embodiment, the apparatus supports an oil and gas well drilling and/or production platform weighing between 500 and 100,000 tons, more particularly, weighing between 3,000 tons and 50,000.

The apparatus of the present invention uses articulating connections between the submerged portion of the buoy and the superstructure to minimize or reduce topside, wave induced motions during the structural life of the apparatus.

The apparatus of the present invention thus enables smaller, multiple hull components to be used to support the superstructure than a single column or single buoy floater.

With the present invention, the topside angular motion is reduced and is less than the topside angular motion of a single column floater of comparable weight.

With the present invention, there is substantially no bending moment or minimum bending moment transferred between each buoy and the structure being supported. The present invention thus minimizes or substantially eliminates moment transfer at the articulating connection that is formed between each buoy and the structure being supported. The buoys are thus substantially free to move in any direction relative to the supported structure or load excepting motion that would separate a buoy from the supported structure.

The present invention has particular utility in the supporting of oil and gas well drilling facilities and oil and gas well drilling production facilities. The apparatus of the present invention has particular utility in very deep water, for example, in excess of 1500 feet.

The present invention also has particular utility in tropical environments (for example West Africa and Brazil) wherein the environment produces long period swell action.

The present invention provides a method of installing an oil and gas well facility such as a drilling facility or a production facility on a platform in an offshore deepwater marine environment. The term "deepwater" as used herein means water depths of in excess of 1500 feet.

The method of the present invention contemplates the placement of a plurality of buoys at a selected offshore location, a portion of each of the buoys being underwater. A superstructure extends above water and includes a platform having an oil and gas well facility. Such a facility can include oil well drilling, oil well production, or a combination of oil well drilling and production. The platform and its facility can be floated to a selected location. The platform includes a peripheral portion having a plurality of attachment positions, one attachment position for each buoy.

When the buoys and platform are located at a desired position, the platform is ballasted relative to the buoys until the buoys connect with the platform. This connection can be achieved by either ballasting the platform downwardly (such as for example, using a ballasted transport barge), or by ballasting the buoys to a higher position so that they engage the supported platform.

In the preferred embodiment, the buoys can be elongated, cylindrically shaped buoys, each having a diameter of for example, 25–100 feet and a height of preferably between about 100 and 500 feet. Each of the buoys can have an upper, smaller diameter portion that includes a connector. In one embodiment, the connector can be convex in shape and articulate with a correspondingly shaped concave connector on the platform.

The platform can include a trussed deck that carries at or near its periphery or corners, connectors that enable a connection to be formed with the upper end portion of each buoy. As an example, there can be provided four buoys and four connectors on the trussed deck or platform.

If a trussed deck is employed, an oil well production facility (drilling or production or a combination) can be supported upon the trussed deck. The connector at the top of each buoy can be any type of an articulating connection that forms an articulation with the trussed deck or a connector on the trussed deck. Examples include the ball and socket or concave/convex arrangement shown in the drawings (FIGS.

1–12). Another example includes the universal joint shown in the drawings (see FIGS. 13–14).

In an alternate method, the multiple buoys can be used as part of an installation method to place the marine platform upon a single spar support.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein:

FIG. 14 is rotated 90 degrees from FIG. 13 around the longitudinal axis of the buoy;

DETAILED DESCRIPTION OF THE INVENTION

Figure 1:
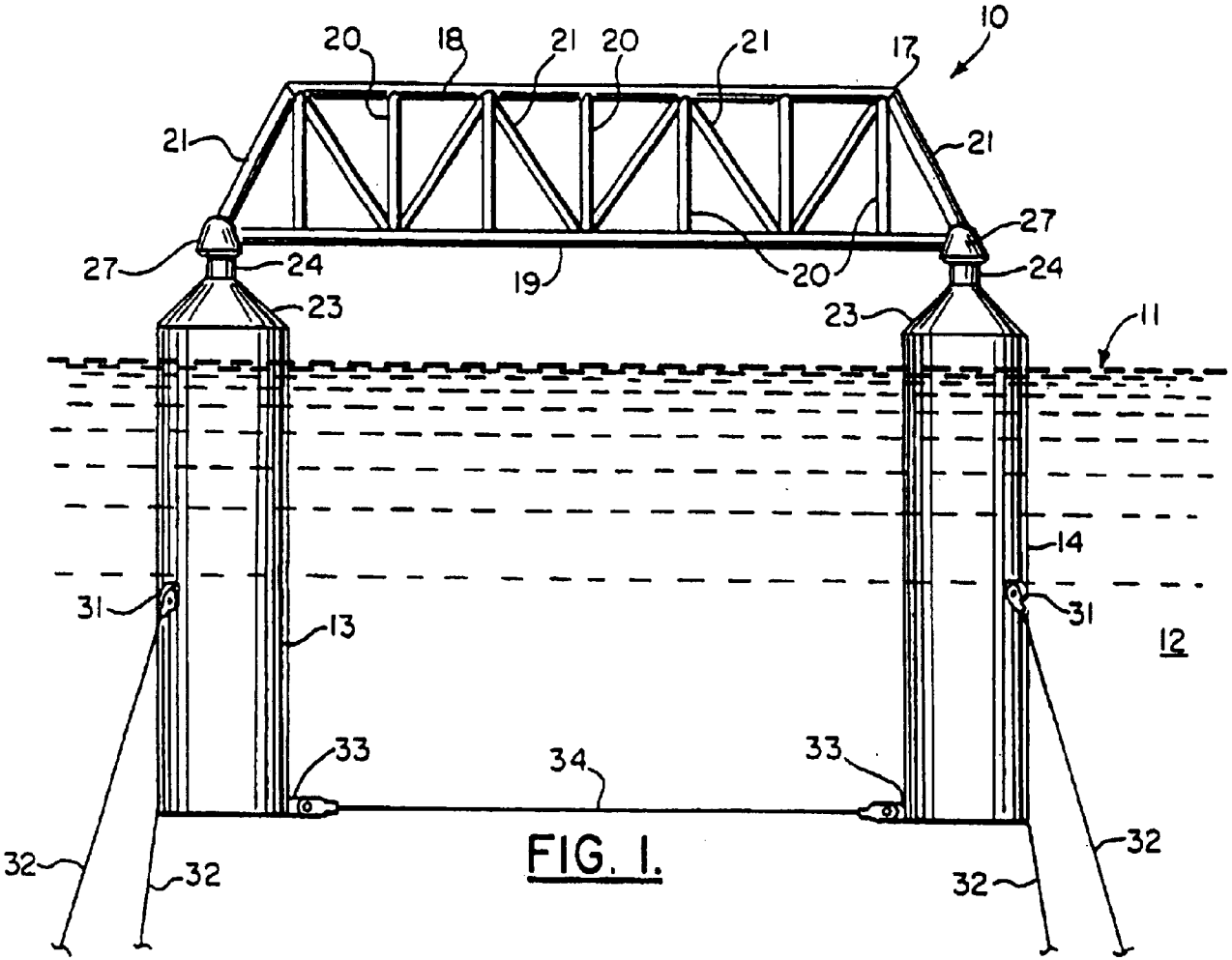
FIG. 1 is an elevation view of a first embodiment of the apparatus of the present invention.

FIGS. 1–6 show a preferred embodiment of the apparatus of the present invention designated generally by the numeral 10 in FIGS. 1–4. In FIGS. 1–4, floating marine platform apparatus 10 is shown in a marine environment or ocean 12 having a water surface 11. The apparatus 10 includes a plurality of buoys 13–16, preferably four (optionally between three (3) and eight (8)), that support a superstructure defined by the combination of platform 17 and drilling and/or producing facilities 53. Oil and gas well producing facility as used herein shall include a facility used for oil and gas well drilling or production, or a combination of drilling and production.

Buoys 13–16 can be any desired shape, including the alternate buoys shown in the drawings or buoys with configurations like those in the September 2000 issue of Offshore Magazine. Platform 17 can be any desired platform or rig, such as a trussed deck constructed of a plurality of upper horizontal members 18, a plurality of lower horizontal members 19, a plurality of vertical members 20 and a plurality of diagonal members 21 to define a trussed deck or platform 17. As shown in FIG. 1, platform 17 can include any desired oil and gas drilling and/or production facility 53, such facilities (in combination with platform 17) defining a superstructure weighing between about 500–100,000 tons, between 3,000–50,000 tons). (See FIGS. 3 and 8).

Figure 5:
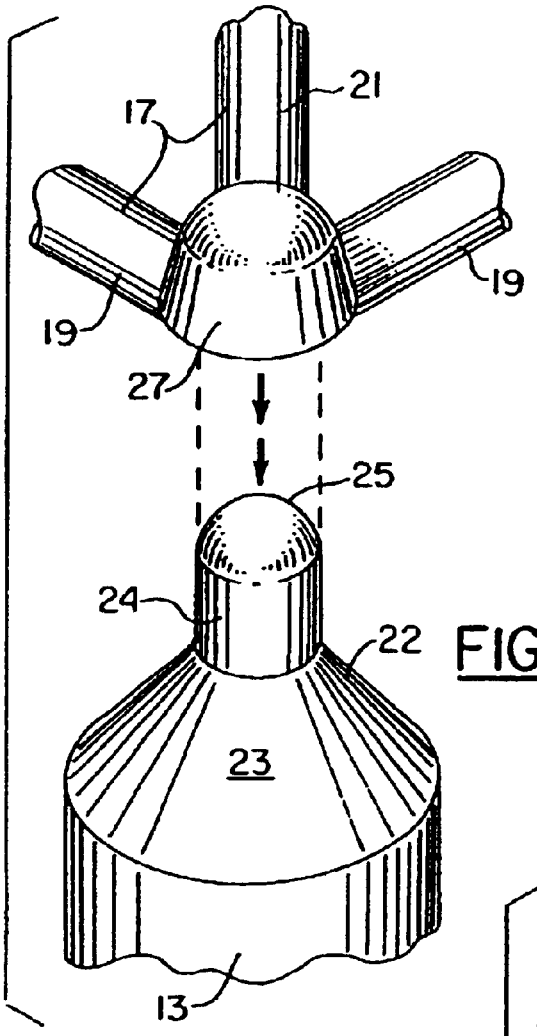
FIGS. 5–6 are fragmentary perspective views of the first embodiment of the apparatus of the present invention illustrating the articulating connection between a buoy and the platform.
Figure 6:
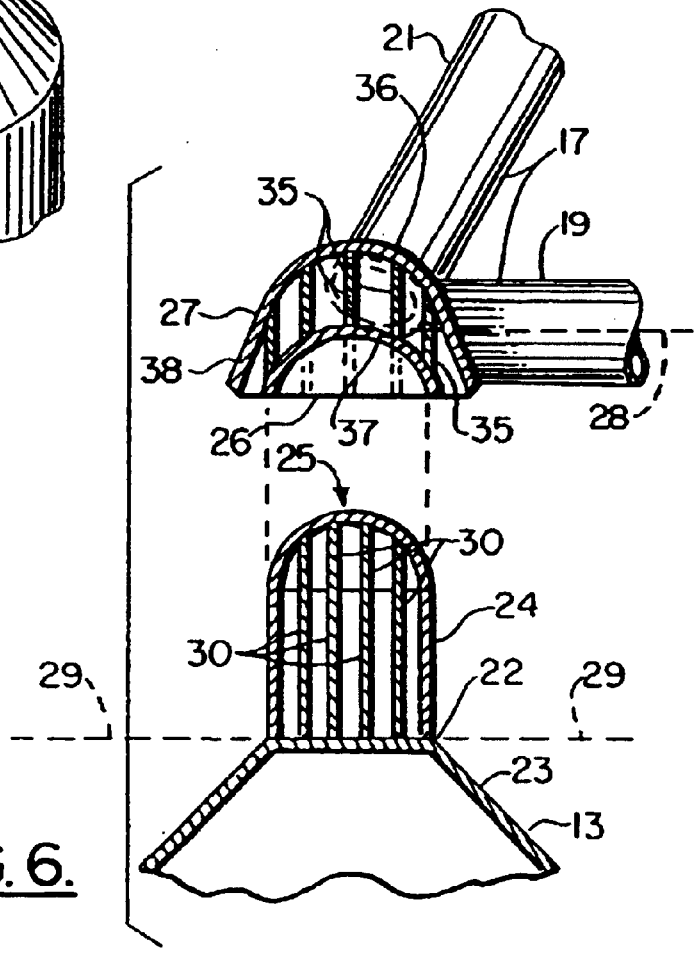

Each buoy 13–16 has an upper end portion 22 that can be conically shaped at 23 (see FIGS. 5–6). An attachment portion 24 provides a convex upper surface 25 that receives a correspondingly shaped concave surface 26 of connecting portion 27 of platform 17. The concave surface 26 can be generally hemispherically shaped. However, the concave surface 26 is curved to articulate upon the surface 25. Surface 26 is preferably smaller than a full hemispherical surface, sized to articulate upon surface 25 even wherein there is an angular variation that can be as much as 30 degrees (or more) between the central longitudinal axis 29 of any one of the buoys and a pure vertical plane. To address wear, bearing materials may be used in the articulating connections which are conventionally available. A preferred bearing material would be graphite impregnated brass or bronze bushing.

The following equations can be used in sizing the buoys:

Heave Period T (heave) = $2\pi\sqrt{(M/K)}$
Where
M = total Heave mass;
K = Heave stiffness;
Heave Stiffness K = $\frac{1}{4}\pi D^2 G$
Where
D = the diameter of the section of the buoy passing through the water plane;
G = the unit weight of water (approximately 65 pounds per cubic foot);
Heave Mass
M = (Dry buoy mass) + (entrapped fluid mass) + (permanent solid ballast mass) + (added virtual fluid mass)

The buoys may be constructed of stiffened steel plate, or continuously cast (slip formed) concrete or through other conventional construction techniques. Typically, a number of internal stiffeners are included to provide the required overall structural strength.

The attachment portion 24 at the upper end of each buoy 13–16 can be reinforced with a plurality of vertical plates 30 as shown in FIG. 6. Likewise, the connection portion 27 of platform 17 can be provided with a plurality of internal reinforcing plates 35. The plates 35 extend between upper curved plate 36 and lower curved plate 37. A conical plate 38 can be attached to (or can be integral with) upper curved plate 36 as shown in FIG. 6. A square harness articulating connection (not shown) going around the primary articulating connection may also be used.

Platform apparatus 10 can be secured to the sea bed 51 using piling or anchors 52 and mooring lines 32, 41 (FIGS. 1–4, 8). In a preferred embodiment (FIGS. 1–4), one or more mooring lines 32 extend from each buoy 13–16 at an upper padeye 31 to the sea bed 51. The mooring lines in FIGS. 1, 2, 3 and 4 extend between padeyes 31 and anchors 52 at sea bed 51.

In a preferred embodiment, a plurality of horizontal mooring lines 34 extend between lower padeyes 33 on two buoys 13, 14 as shown in FIG. 1. While the lower horizontal mooring lines 34 are shown connecting to buoys 13, 14, it should be understood that each pair of buoys (14–15, 15–16, 16–13) has a horizontal line 34 extending there between in the same configuration shown in FIG. 1.

Figure 7:
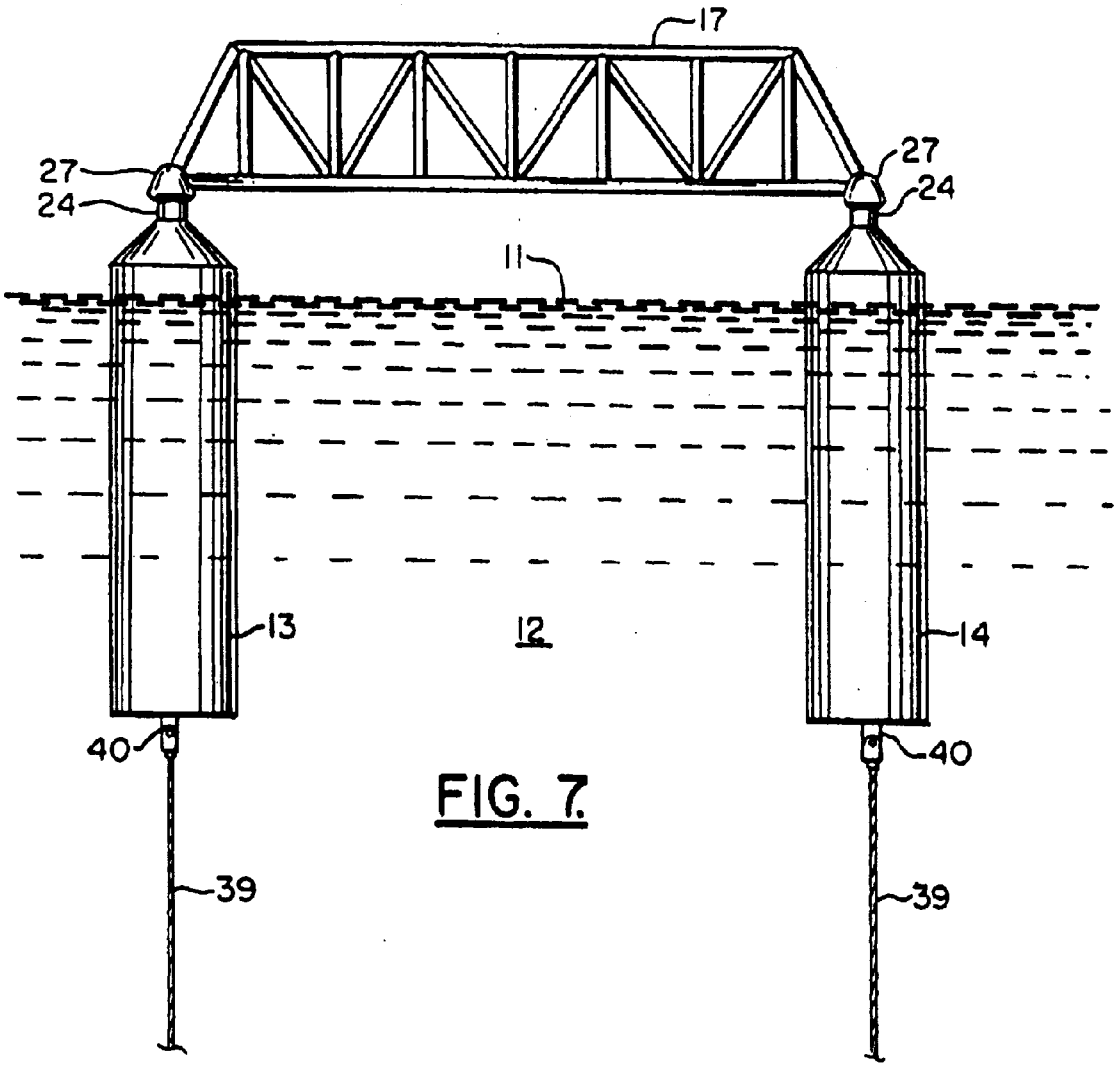
FIGS. 7–8 show alternate mooring arrangements for the apparatus of the present invention.

FIG. 7 shows a first alternate embodiment of the present invention, utilizing tensioned mooring lines 39 that extend between connection points (eg. padeyes) 40 on each of the buoys 13–16 and anchors (such as 52) embedded in the sea bed 51. In the embodiment of FIG. 7, horizontal mooring lines 34 could optionally be provided between each pair of buoys such as 13 and 14, or 14 and 15, or 15 and 16, or 16 and 13.

Figure 8:
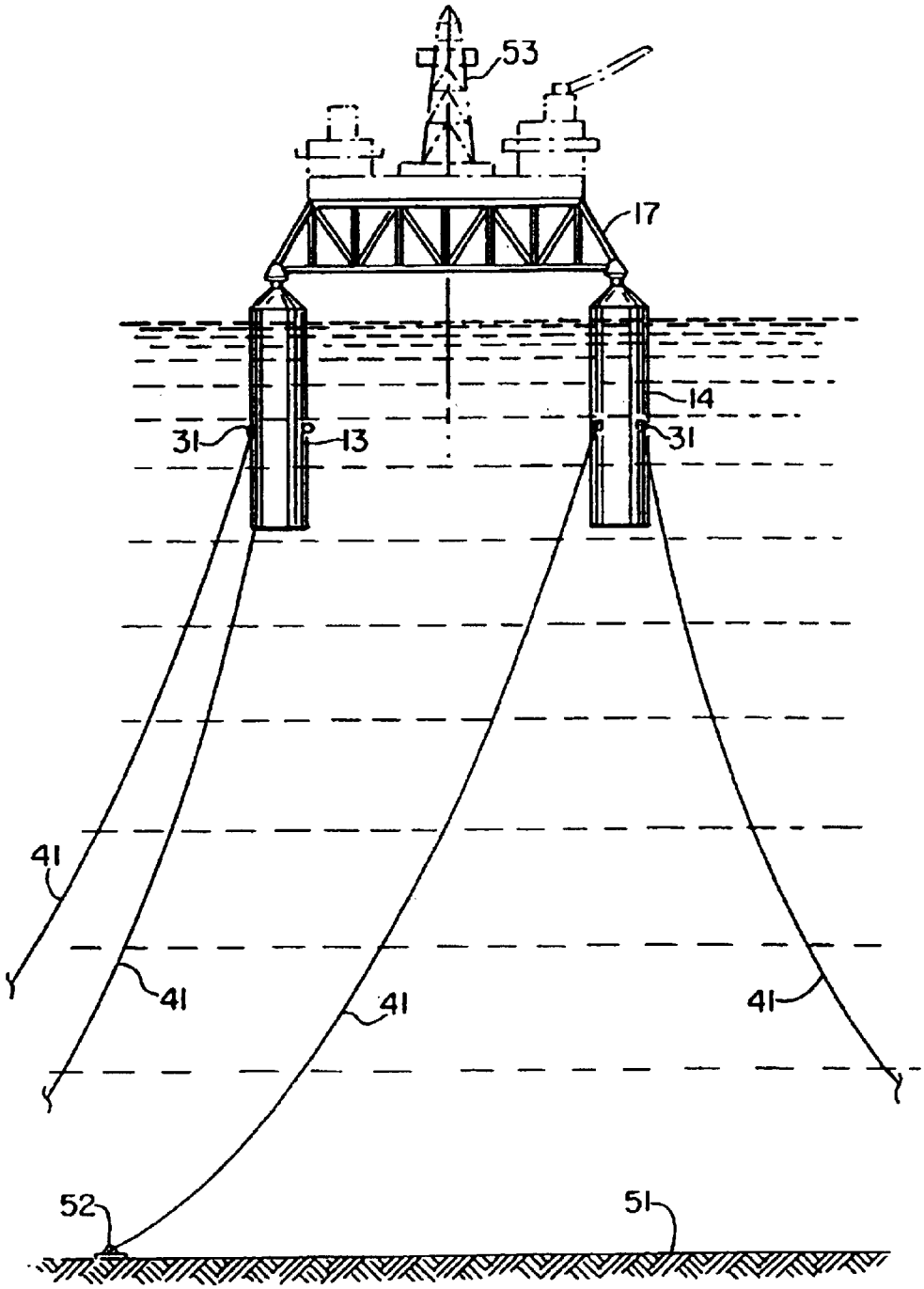

FIG. 8 shows an alternate arrangement wherein caternary mooring lines 41 extend between padeyes 31 and the anchors 52 that are anchored to the sea bed 51. In this embodiment, there are no horizontal lines connecting the buoys.

Figure 2:
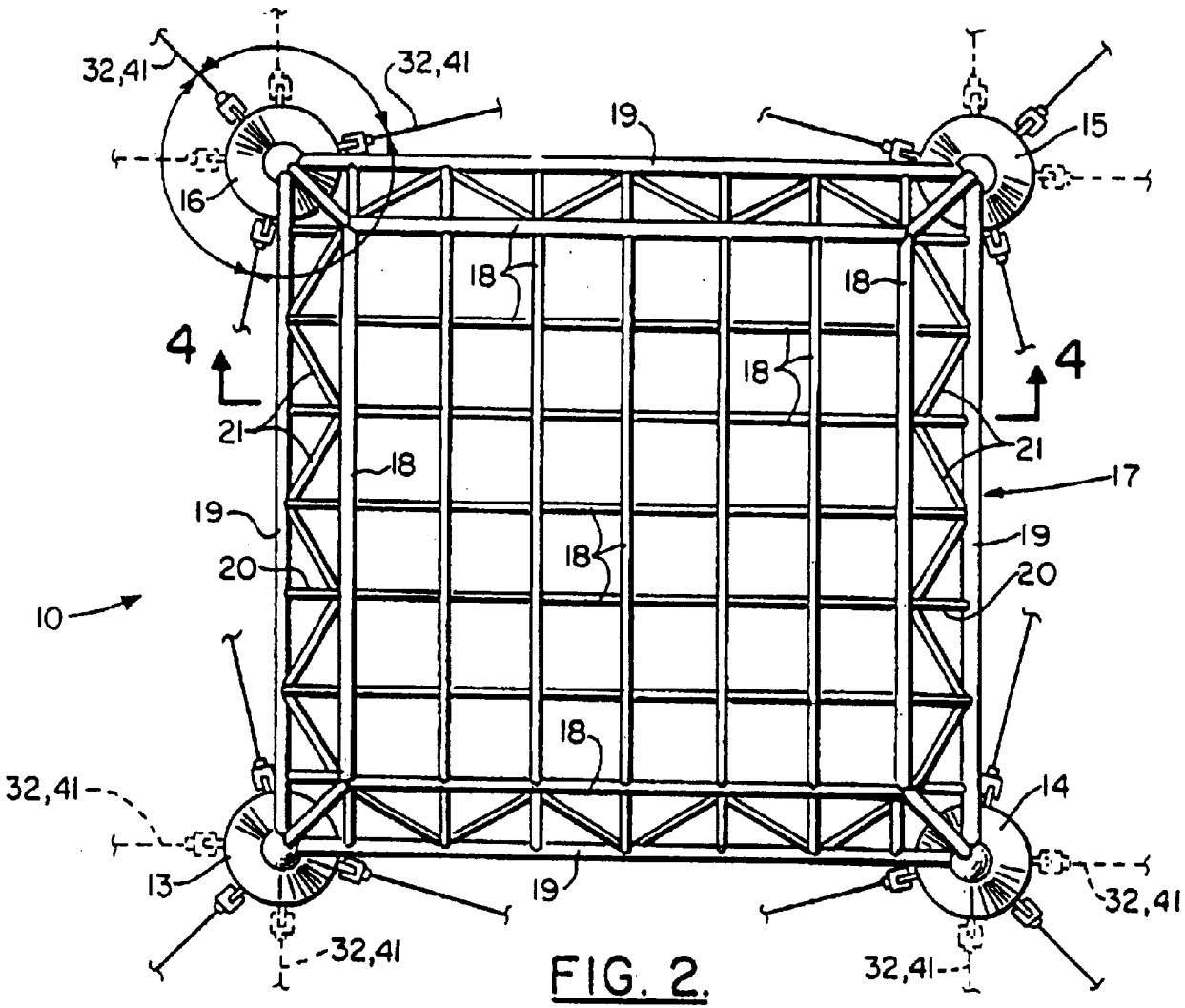
FIG. 2 is a plan view of a preferred embodiment of the apparatus of the present invention.
Figure 3:
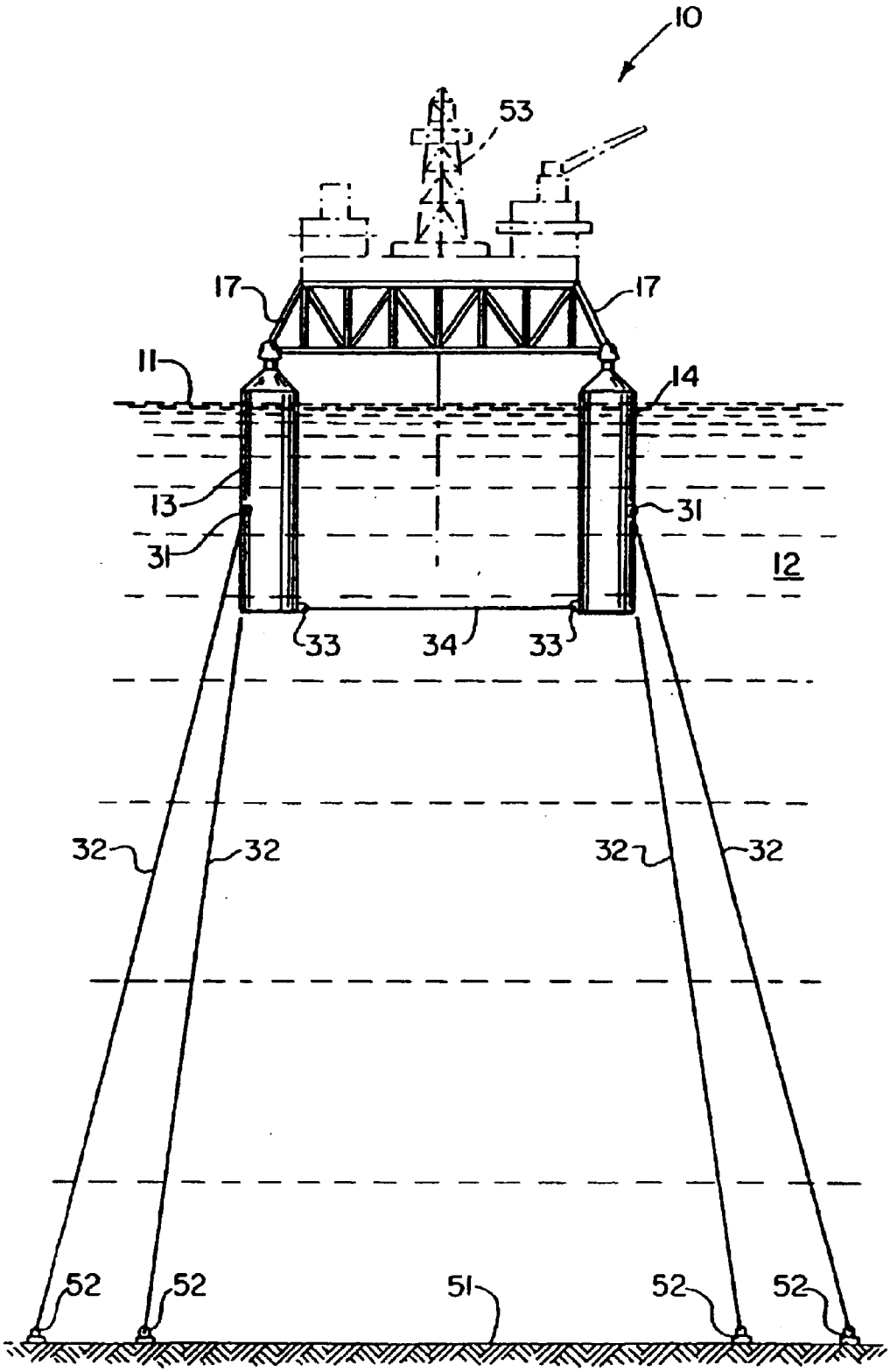
FIG. 3 is another elevation view of a first embodiment of the apparatus of the present invention.
Figure 4:
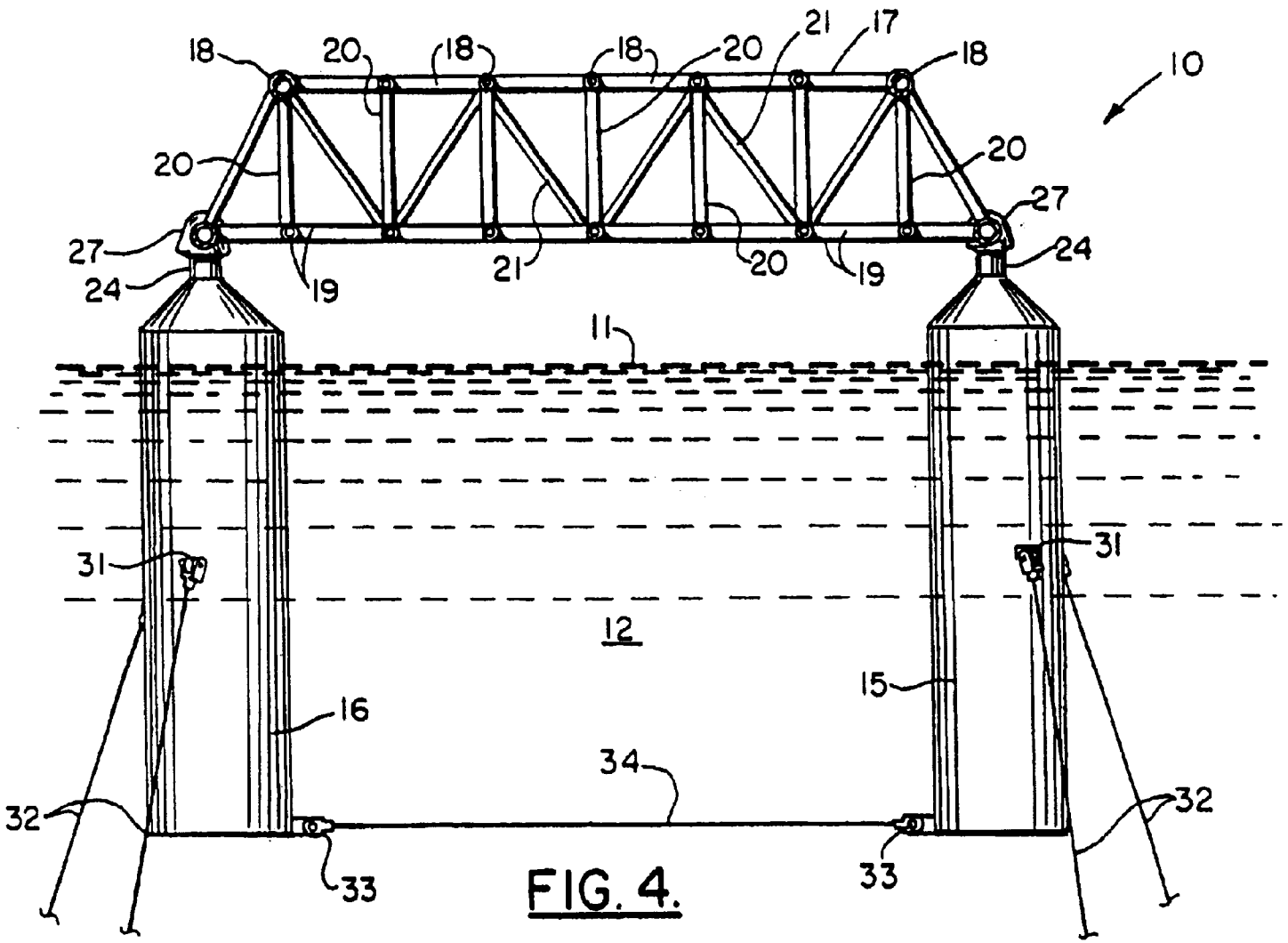
FIG. 4 is a sectional view taken along lines 4—4 of FIG. 2.

The plan view of FIG. 2 shows various orientations that could be used for either mooring lines 32 or mooring lines 41. One arrangement provides a plurality of three mooring lines 32 or 41 attached to each buoy 13–16, the mooring lines 32 or 41 being spaced about 120 degrees apart as shown in hard lines. In phantom lines in FIG. 2, another geometry for the mooring lines 32, 41 is shown, wherein there are two mooring lines for each spur that are about 90 degrees apart.

The platform 17 is constructed of upper and lower sets of horizontal members 18, 19; vertical members 20; and diagonal members 21.

Figure 9:
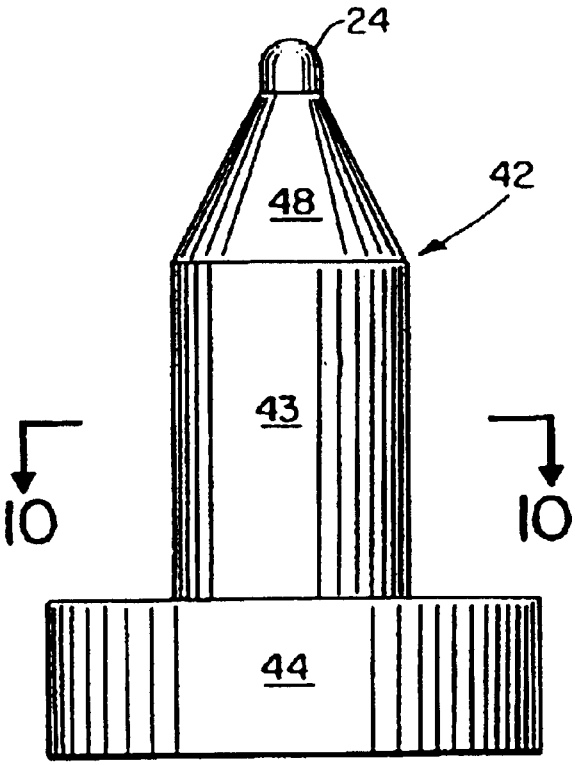
FIG. 9 is a partial elevation view of a second embodiment of the apparatus of the present invention that features buoys of variable diameter.
Figure 10:
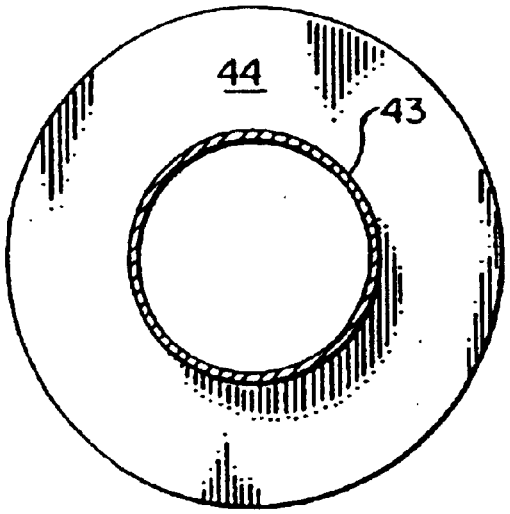
FIG. 10 is a sectional view taken along lines 10—10 of FIG. 9.
Figure 10A:
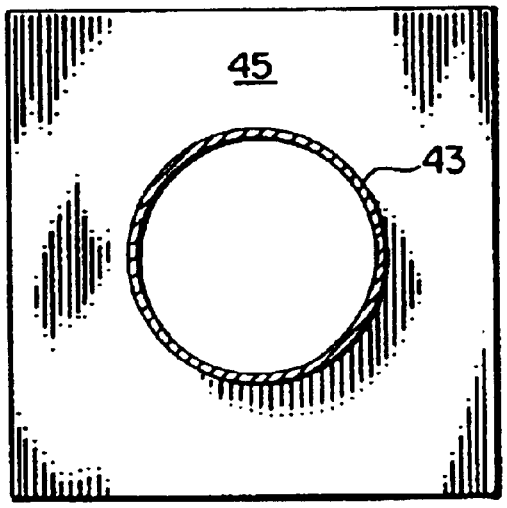
FIG. 10A is a sectional view taken along lines 10—10 of FIG. 9 and showing a buoy lower end portion that is square.

FIGS. 9, 10 and 10A show an alternate construction for each of the buoys. It should be understood that a buoy such as one of those shown in FIGS. 9, 10 or 10A could be used to replace any one or all of the buoys 13–16 shown in FIGS. 1–4 and 5–6.

Buoy 42 can be provided with a variable diameter having a smaller diameter cylindrical middle section 43, and a larger diameter lower section 44 which can be for example, either cylindrical (See FIG. 10) or squared (see FIG. 10A). The cylindrical lower section 44 is shown in FIGS. 9 and 10, and the squared lower section 45 shown in FIG. 10A.

Figure 11:
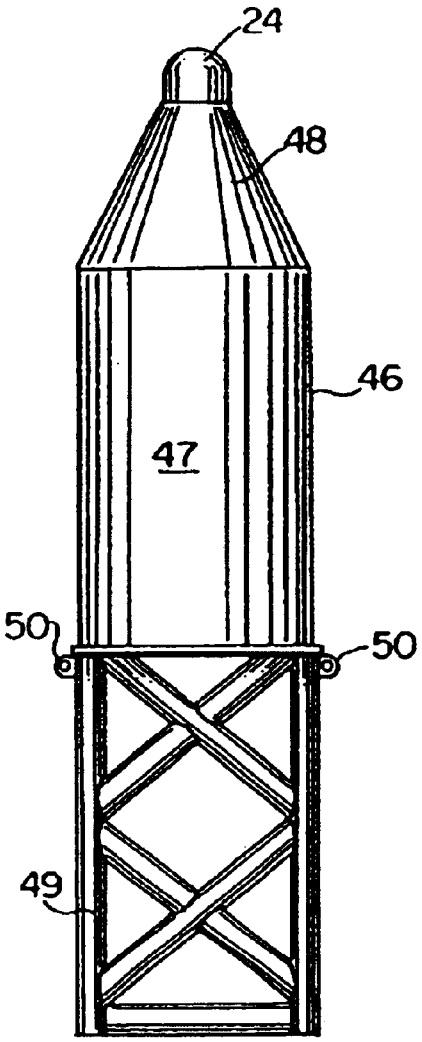
FIG. 11 is a partial elevation view of a third embodiment of the apparatus of the present invention showing an alternate buoy construction.
Figure 12:
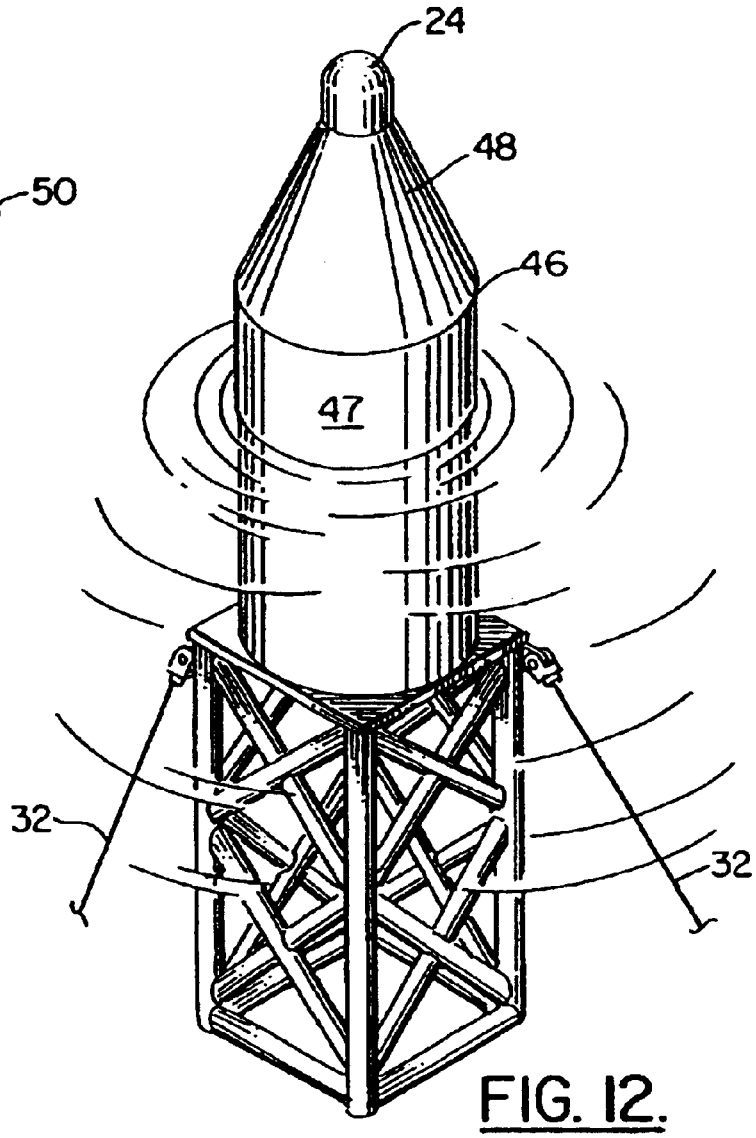
FIG. 12 is a perspective elevation view of a third embodiment of the apparatus of the present invention showing an alternate buoy construction.

Another buoy construction is shown in FIGS. 11 and 12. It should be understood that the buoy shown in FIGS. 11 and 12 could be used to replace any one or all of the plurality of buoys 13–16 of FIGS. 1–6. In FIGS. 11 and 12, the buoy 46 has a cylindrical middle section 47, a conical upper section 48, and a trussed lower section 49. Padeyes 50 on the upper end portion of trussed lower section 49 can be used to support any of the afore described mooring lines such as 32, 39, or 41. In the embodiment of FIGS. 11 and 12, each of the buoys 46 can have a similar construction and configuration at the upper end portion to that of a preferred embodiment shown in FIGS. 1–6, providing a conical upper section 48 and a attachment portion 24.

Figure 14:
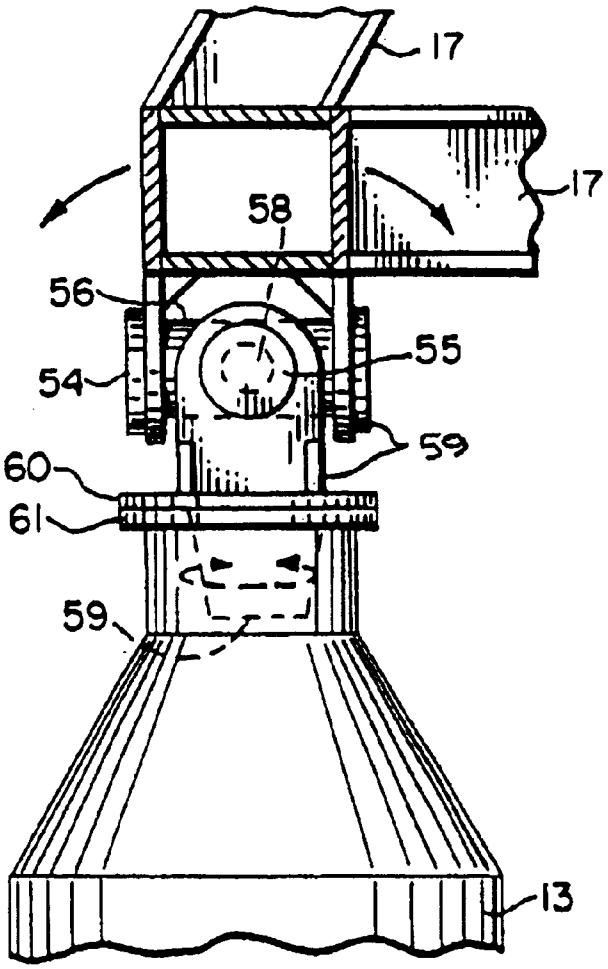
FIGS. 13–14 are elevation views of a fourth embodiment of the apparatus of the present invention showing an alternate articulating connection between each buoy and the platform.
Figure 13:
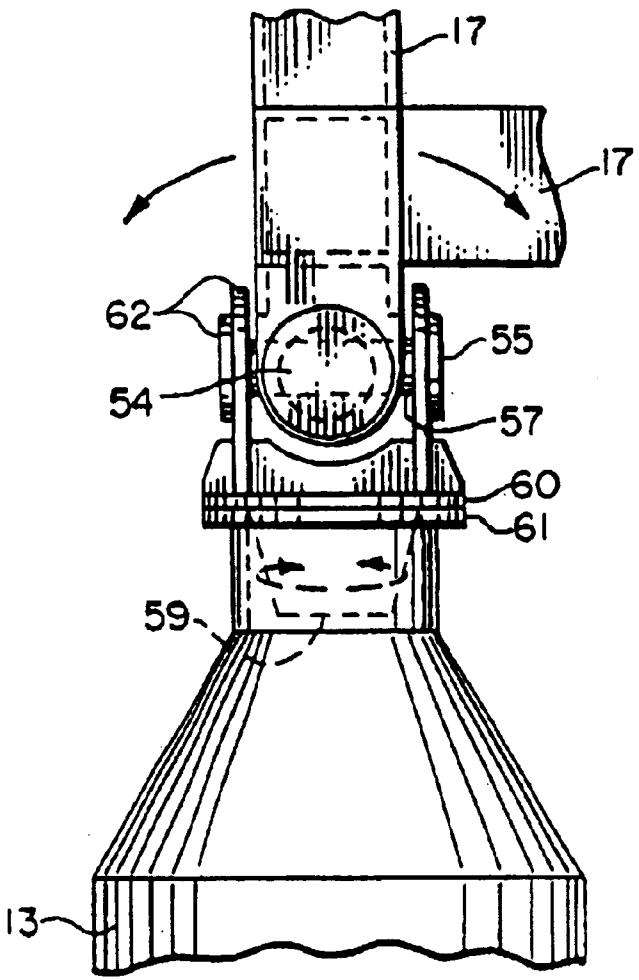

In FIGS. 13 and 14, there can be seen an alternate articulating connection between platform 17 and a selected buoy 13 (or 14–16 or 42, or 46). A gimble or universal joint 59 arrangement is shown in FIGS. 13 and 14, providing a first pinned connection at 54 and a second pinned connection at 55. The first pin 56 can be of a larger diameter, having a central opening 58 through which the second, smaller diameter pin 57 passes as shown. The central longitudinal axes of the pins 54, 55 preferably intersect. In FIGS. 13–14, a buoy 13, 14, 15, 16 can optionally be made to rotate relative to the gimbal or universal joint 59 connection shown. Bearing plates 78, 79 can rotate relative to one another. To minimize frictional force transference and wear, both pins 56, 57 can be mounted in bearings.

Each of the buoys 13, 14, 15, 16 will move due to current and/or wind and/or wave action or due to other dynamic marine environmental factors. "Articulating connection" as used herein should be understood to mean any connection or joint that connects a buoy to the superstructure, transmits axial and shear forces, and allows the support buoy(s) to move relative to the superstructure without separation, and wherein the bending moment transferred to the superstructure from one of the so connected buoys or from multiple of the so connected buoys is reduced, minimized or substantially eliminated.

Figure 17:
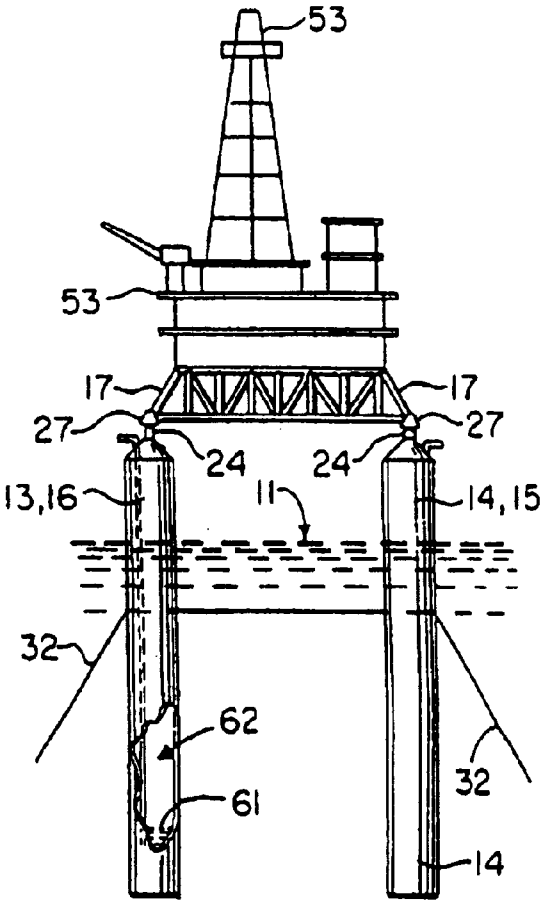
FIG. 17 is an elevation view illustrating the method of the present invention including the final step of ballasting the combination of structure and plurality of buoys until a desired elevational position is achieved.
Figure 18:
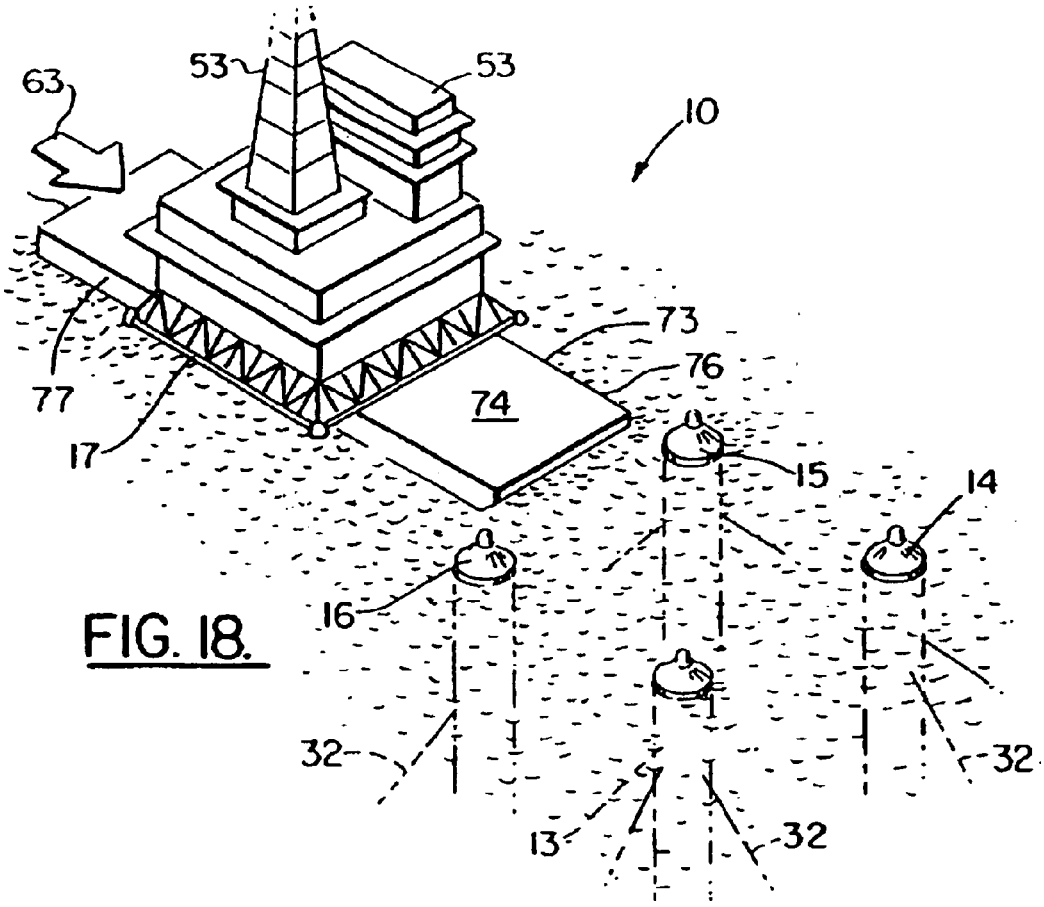
FIG. 18 is a perspective view illustrating the first step of the method of the present invention.

In FIGS. 15–17 and 18–19, the method of the present invention is disclosed. In FIG. 18, arrow 63 designates travel of a transport barge 73 toward a plurality of buoys 13, 14, 15, 16 that have been positioned at a desired location. Buoys 13, 14, 15, 16 are held in that position using for example, a plurality of anchor lines 32 as shown in FIGS. 15–19.

Transport barge 73 provides an upper deck 74, a bottom 75, a port side 76 and a starboard side 77. The barge 73 also has end portions 64, 65. Transport barge 73 can be any suitable barge having a length, width, and depth that are suitable for transporting a multi-ton superstructure to a job site. Typically, such a superstructure 53 mounted upon platform 17 will be a multi-ton structure that is capable of performing oil and gas well drilling activities and/or oil and gas well production activities.

Figure 19:
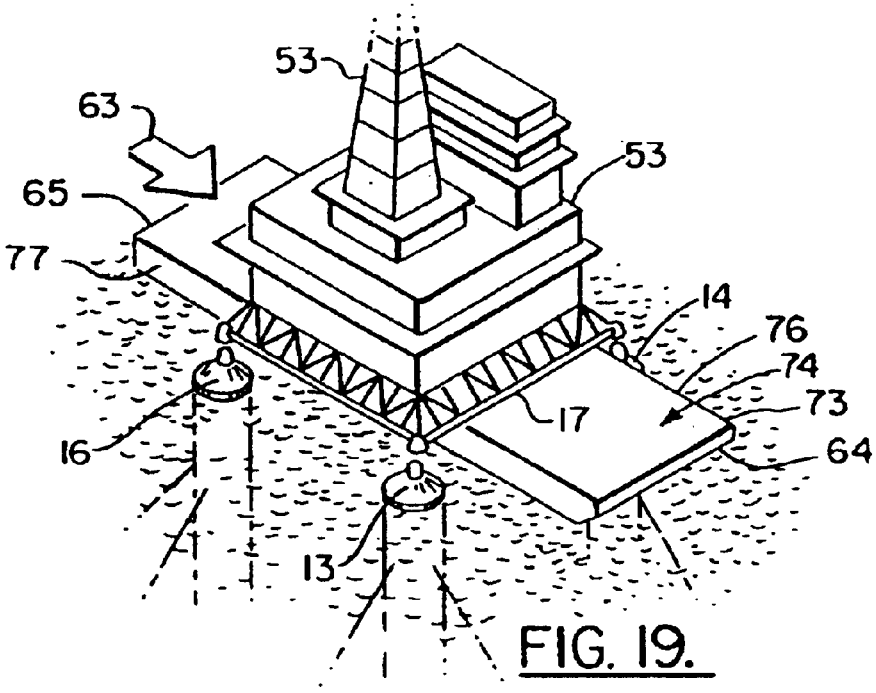
FIG. 19 is a perspective view illustrating the second step of the method of the present invention.

In FIG. 19, barge 73 has been positioned next to the plurality of buoys 13, 14, 15, 16. As an example, FIGS. 18–19, the transport barge 73 has been positioned so that the buoys 13, 16 are on the starboard side 77 of transport barge 73. The buoys 14, 15 are positioned on the port side 76 of transport barge 73 as shown in FIGS. 15–17 and 19.

Figure 16:
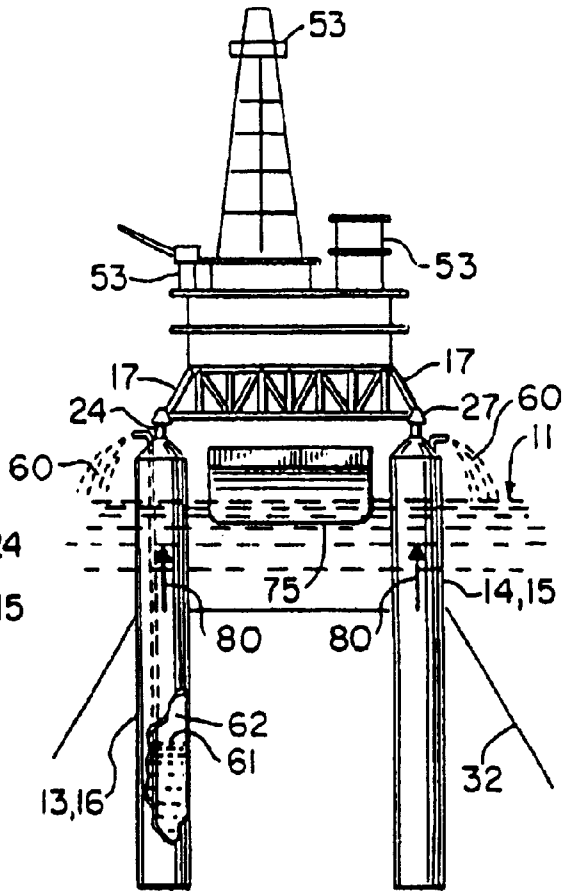
FIG. 16 is an elevation view illustrating the method of the present invention, specifically the step of ballasting the buoys relative to the barge during a connection of the buoys to the oil and gas well drilling and/or production facility to be supported.
Figure 15:
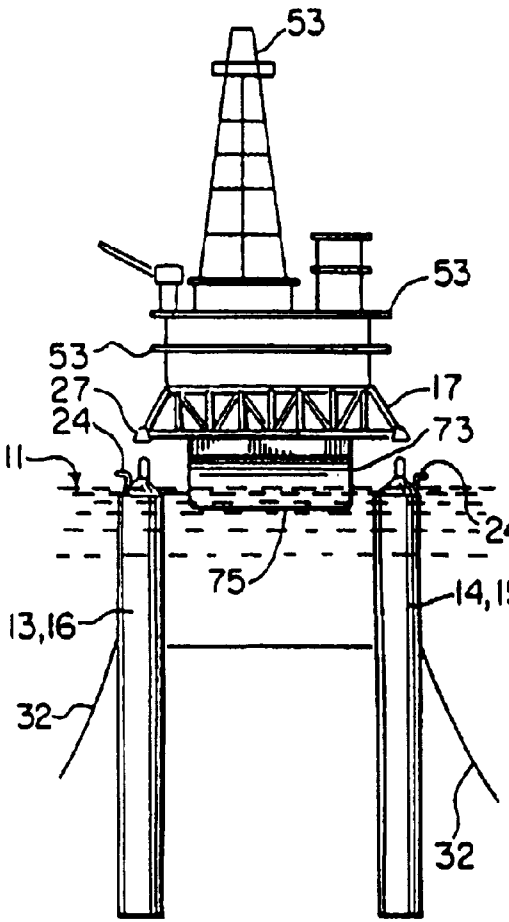
FIG. 15 is an elevation view illustrating a first embodiment of the method of the present invention, specifically the first step of floating the marine platform to a desired location next to a plurality of buoys that will support the platform.

Once in the position shown in FIGS. 15 and 19, a ballasting operation moves the buoys 13, 14, 15, 16 into contact with the platform 17 so that a connection is perfected. More specifically, the attachment portions 24 of the respective buoys 13, 14, 15, 16 engage and form an articulating connection with the corresponding connecting portions 27 of platform 17 as shown in FIGS. 15–17 and in FIGS. 1–8 and 13–14.

Ballasting can be achieved by initially adding water to the interior 62 of each of the buoys 13, 14, 15, 16 so that they are at a lower position in the water as shown in FIGS. 15 and 18–19. The water can then be pumped from the interior of each of the buoys 13, 14, 15, 16 as indicated schematically by the numeral 60 in FIG. 16. As water is removed from the interior of each of the buoys 13–16, the water level 61 in each of the buoys 13–16 will drop and each of the buoys 13–16 will rise as indicated schematically by arrows 80 in FIG. 16.

Each of the buoys 13, 14, 15, 16 will be ballasted upwardly in the direction of arrows 80 until its attachment portion 24 forms a connection with the connecting portion 27 of platform 17. Alternatively, the barge 73 can be positioned as shown in FIGS. 15 and 19. The barge 73 can then be lowered so that the barge 73, platform 17 and drilling/production facility 53 lower with it until the connection portions 27 of platform 17 rest upon the attachment portions 24 of the buoys 13–16.

As still a further alternative, a combination of ballasting of barge 73 and buoys 13, 14, 15, 16 can be used to connect each of the attachment portions 24 of buoy 13, 14, 15, 16 to platform 17 so that the attachments shown in FIGS. 1, 2, 3, 4, 7, 8 are achieved. For example, barge 73 can be lowered using ballasting while buoys 13, 14, 15, 16 are simultaneously elevated using ballasting.

For the embodiment of FIGS. 13 and 14, a similar ballasting arrangement can be provided wherein the pinned connections 54, 55 are added after the platform 17 and buoys 13, 14, 15, 16 are at the proper elevational positions relative to one another.

Once the superstructure that includes platform 17 and facility 53 is supported as shown in FIG. 17, the superstructure (platform 17 and facility 53) can be placed upon a single spar support 66 if desired using the apparatus 10 of the present invention as a transfer apparatus.

After removal of barge 73 (see FIGS. 15–19), tow boats 69 can be used to tow each buoy 13, 14, 15, 16 to spar 66. For example, each boat 69 can provide a tow line 70 attached to a buoy 13,. 14, 15 or 16, or to deck 17 at a provided attachment 71.

Figure 20:
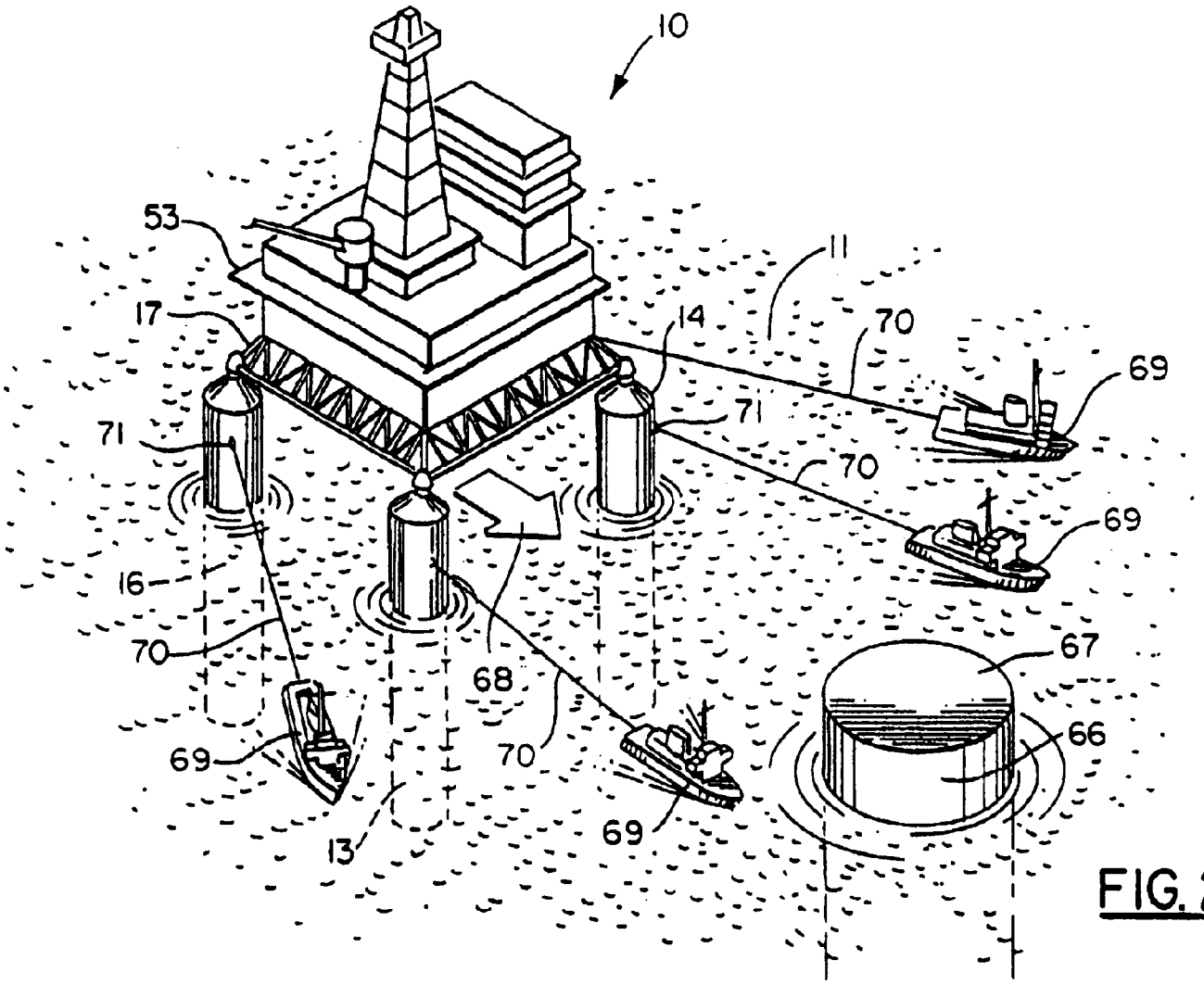
FIG. 20 is a perspective view illustrating an alternate method of the present invention wherein the apparatus of the present invention is used to place a marine platform upon a single spar support.
Figure 21:
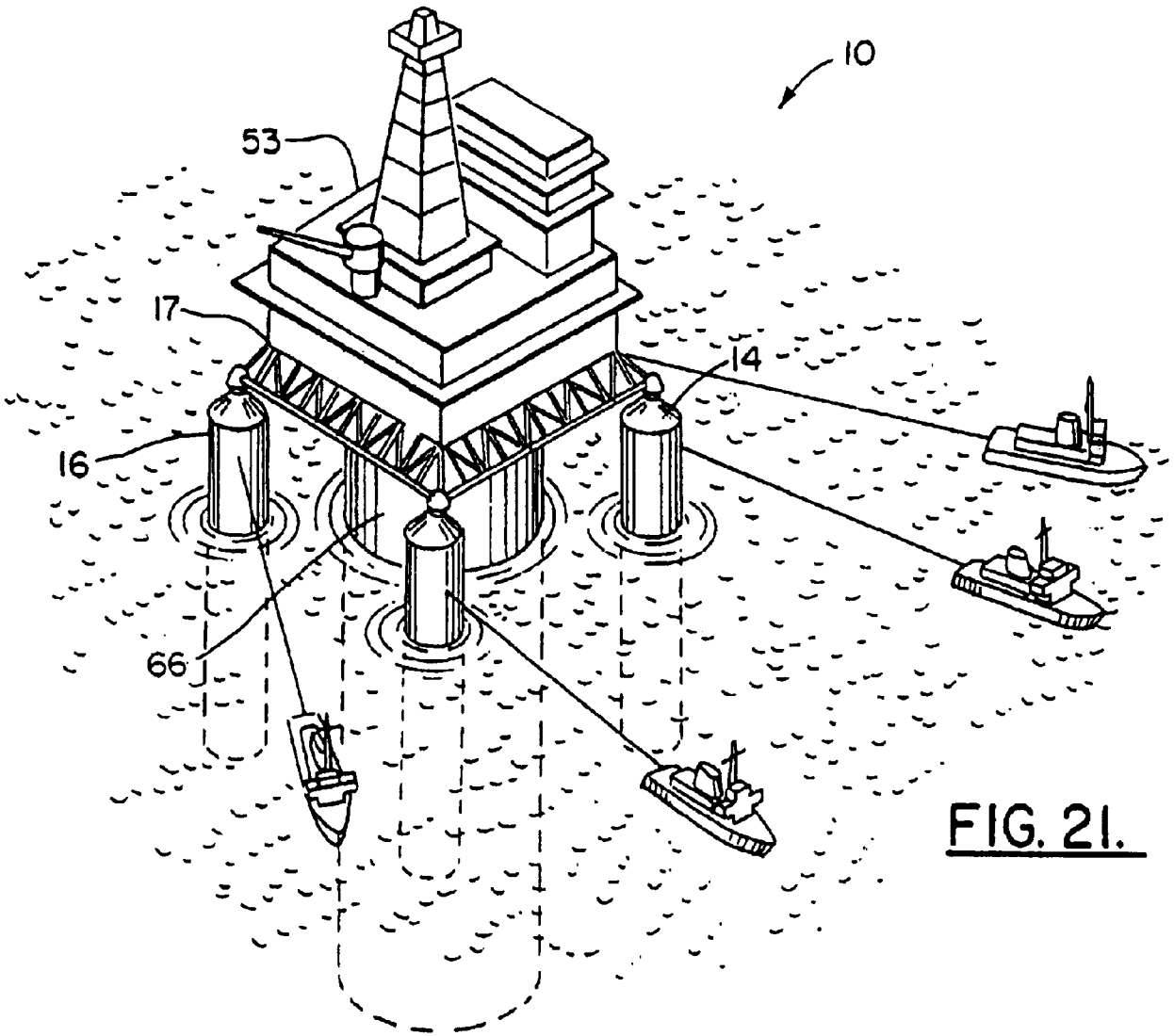
FIG. 21 is a perspective view illustrating an alternate method of the present invention wherein the apparatus of the present invention is used to place a marine platform upon a single spar support.
Figures 22, 23, 24:
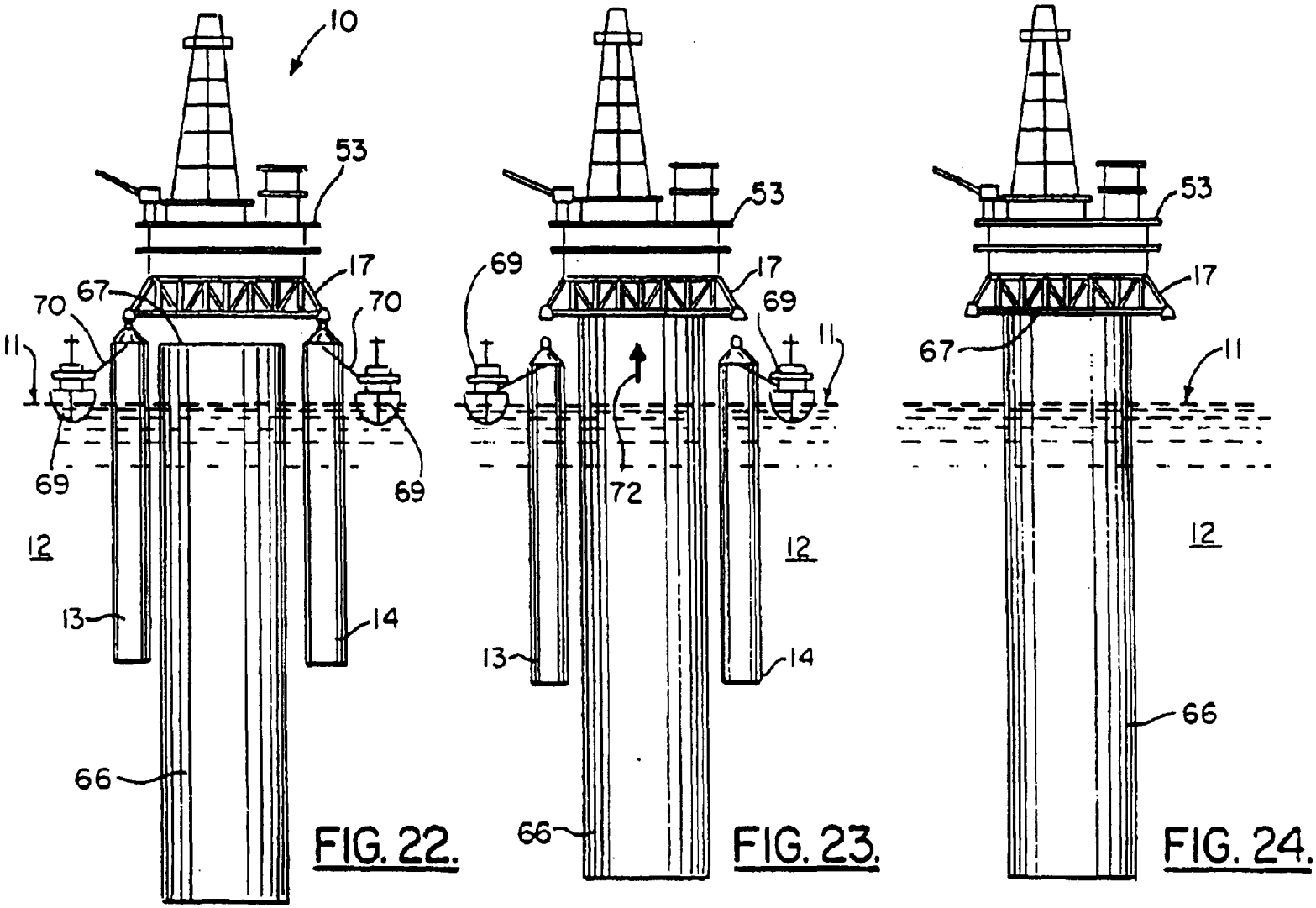
FIG. 22 is an elevation view illustrating an alternate method of the present invention wherein the apparatus of the present invention is used to place a marine platform upon a single spar support.
FIG. 23 is an elevation view illustrating an alternate method of the present invention wherein the apparatus of the present invention is used to place a marine platform upon a single spar support.
FIG. 24 is an elevation view illustrating an alternate method of the present invention, showing the platform after placement upon a single spar and removal of all supporting buoys.

In FIGS. 20, 21, and 22, the boats 69 pull buoys 13, 14, 15, 16 to a position as shown that overlays platform 17 with upper end portion 67 of spar 66. Ballasting can then be used to either elevate spar 66 or lower buoys 13, 14, 15, 16 (or a combination of such ballasting can be used) to engage spar 66 upper end portion 67 with platform 17 as indicated by arrow 72 in FIG. 23.

Additional ballasting separates each buoy 13, 14, 15, 16 from platform 17 so that spar 66 alone supports platform 17 and its facility 53 (see FIG. 24).

FIGS. 25–31 show another alternate method and apparatus of the present invention, the alternate apparatus of FIGS. 25–31 being designated generally by the numeral 10A in FIGS. 27, 29, 30, and 31.

Figure 26:
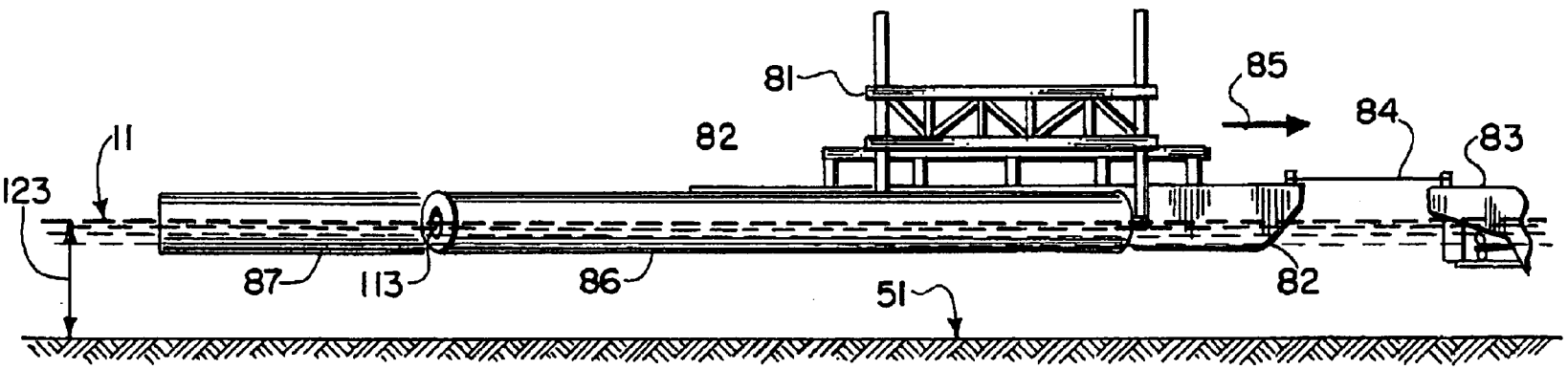
FIG. 26 is an elevation view showing the fifth method of the present invention.

The alternate embodiment of the floating marine platform apparatus 10A can be used to transport a platform 81 from a relatively-shallow location as shown in FIG. 26 having a first water depth 123 that is less than the overall length of any one of the buoys 86–89 to a deep water location wherein the water depth is a dimension that is greater than the length of any one of the buoys 86–89.

The alternate method and apparatus of FIGS. 25–31 enables an assembly of a transport vessel 82, platform 81, and buoys 86–89, to be transported with a tug, tugboat or tow vessel 83 from a shallow water location having a shallow water depth indicated by arrow 123 in FIG. 26 to a deep water location wherein the water depth is hundreds or even thousands of feet deep. The entire platform 81, transport vessel 82, and buoys 86–89 assembly can be configured at a dock area next to a fabricator's facility and then transported to deep water, minimizing the expense of offshore deep water assembly. Once the combination of transport vessel 82, platform 81, and buoys 86–89 is completed at a selected facility, fabrication yard or the like, all that is required for travel to the destination is a tow line 84 or other suitable rigging joining the tugboat 83 and transport vessel 82.

Figure 25:
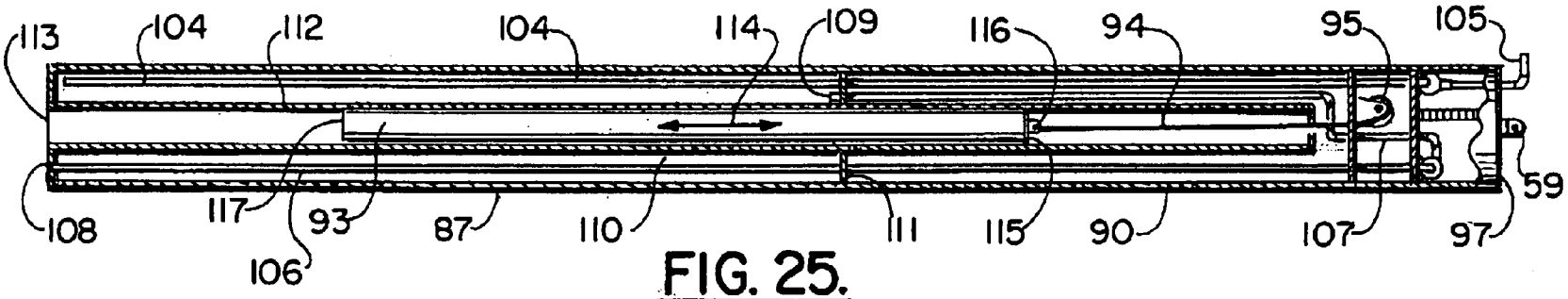
FIG. 25 is a partial sectional elevation view of a fifth embodiment of the apparatus of the present invention.
Figure 28:
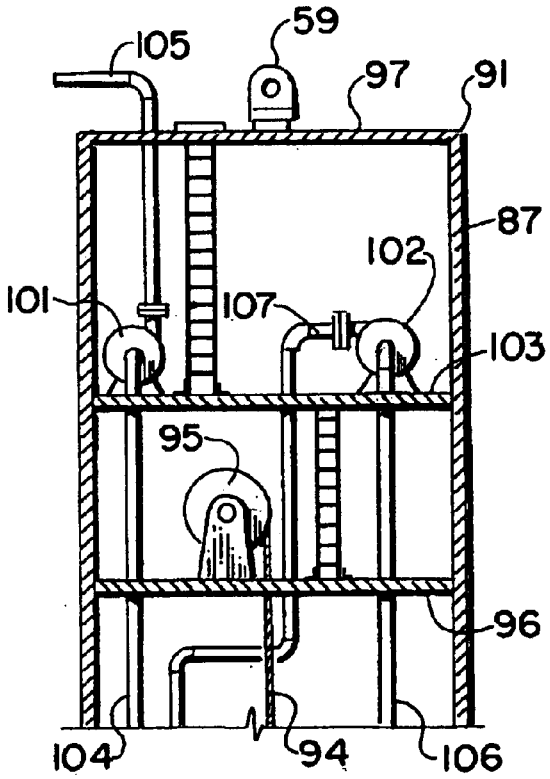
FIG. 28 is a partial sectional elevation view of the fifth embodiment of the apparatus of the present invention.
Figure 29:
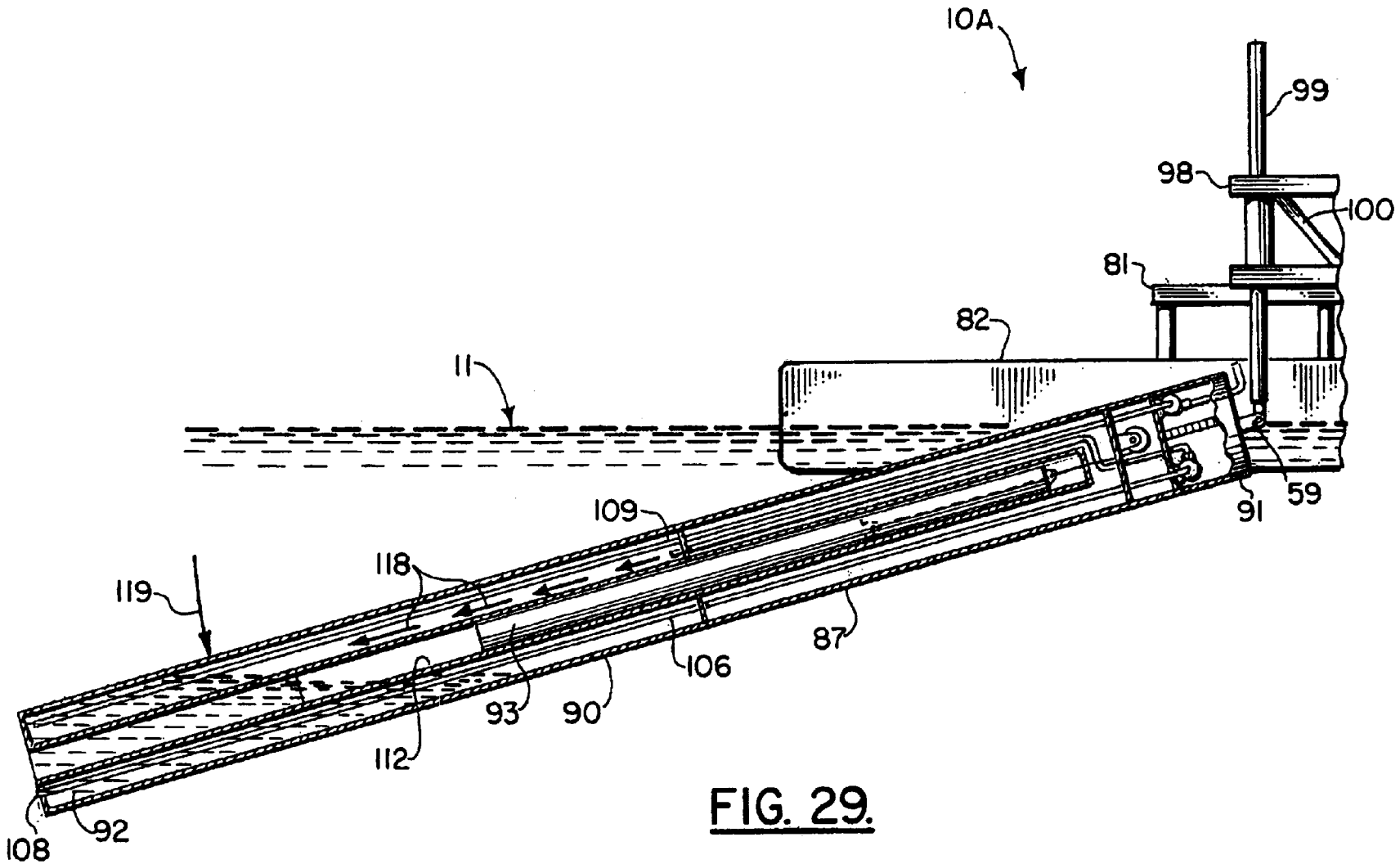
FIG. 29 is a partial sectional elevation view of the fifth embodiment of the apparatus of the present invention.

The apparatus of the present invention provides an improved buoy arrangement, and for each of the buoys 86–89 this construction can be substantially the same. The alternate construction provides a ballast member, ballast rod or ballast weight 93 that moves (e.g. linearly) within a provided tube or sleeve 112 housed within the interior 110 of each buoy 86, 87, 88 or 89. For simplification, the construction of only one such buoy 87 is shown in FIGS. 25, 28 and 29, as all buoys 86–89 can be of essentially identical construction.

Buoy 87 has an upper end portion 91, lower end portion 92, and a sleeve 112 mounted within its interior 110. A lift line 94 is wound upon a provided winch 95 for raising and lowering the ballast weight 93 with respect to the sleeve 112. A winch deck 96 can be provided at the upper end portion 91 of buoy 87 as shown in FIG. 28. The upper end portion 91 of buoy 87 can be provided with a transverse upper deck or bulkhead 97.

The platform 81 to be transported can include for example a plurality of horizontal sections 98, a plurality of vertical sections 99, and diagonal bracing members or sections 100. In the embodiment shown in FIGS. 25–31, each buoy 86, 87, 88, 89 can be joined to platform 81 at a vertical section 99 for example. This connection between platform 81 at vertical section 99 is preferably an articulating connection or universal joint 59 such as any one of the articulating connections shown and described with respect to FIGS. 1–24. Alternatively, the articulating connection can be any of the articulating connections as shown and described in any one of my prior U.S. Pat. Nos. 6,425,710;6,435,773; or 6,435,774 each of which is hereby incorporated herein by reference.

Figure 30:
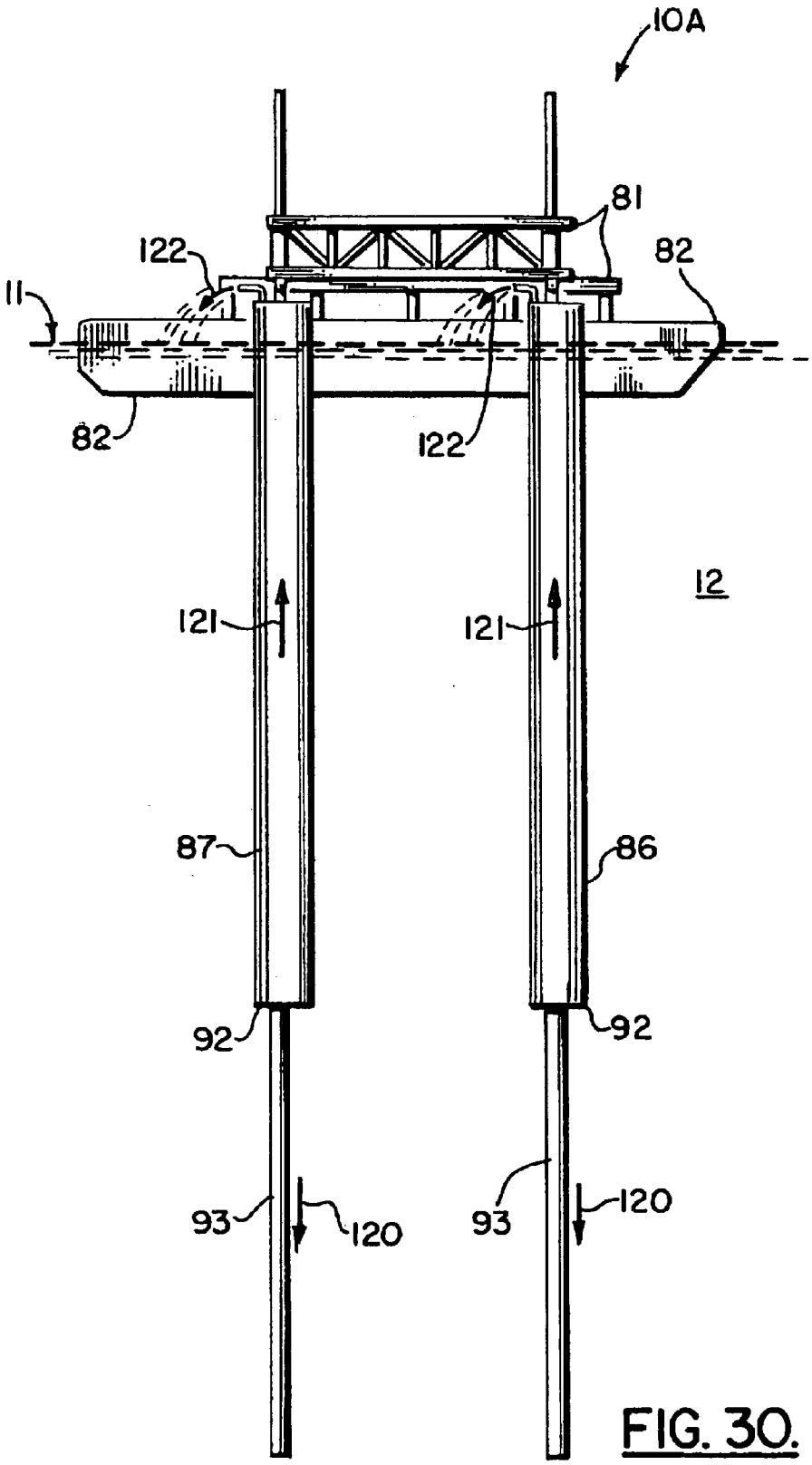
FIG. 30 is a schematic elevation view illustrating an alternate method of the present invention.

A pair of pumps 101, 102 are mounted in the upper end portion 91 of each buoy 86–89. In the exemplary view of FIG. 28, a pump deck 103 is provided for housing pumps 101 and 102. Pump 101 provides a suction line 104 for intaking water that is to be pumped from the interior 110 of buoy 86, 87, 88 or 89. The suction line 104 is used to empty water that has been added to the selected buoy 86–89 during ballasting operations that lower the buoy from a generally horizontal position as shown in FIG. 26 to an inclined position as shown in FIG. 29, and then finally to a generally vertical position as shown in FIG. 30. Discharge line 105 extends externally of buoy 86, 87, 88 or 89 for emptying water from the interior 110 of buoy 87 to the exterior thereof.

Pump 102 is provided with suction line 106 and discharge line 107. The suction line 106 communicates with seawater intake opening 108 so that the suction line 106 can intake seawater to be used in ballasting operations. The discharge line 107 has a discharge outlet 109 that is positioned within buoy interior 110 as shown in FIG. 26 so that water can be added during ballasting operations to the buoy interior 110.

Figure 31:
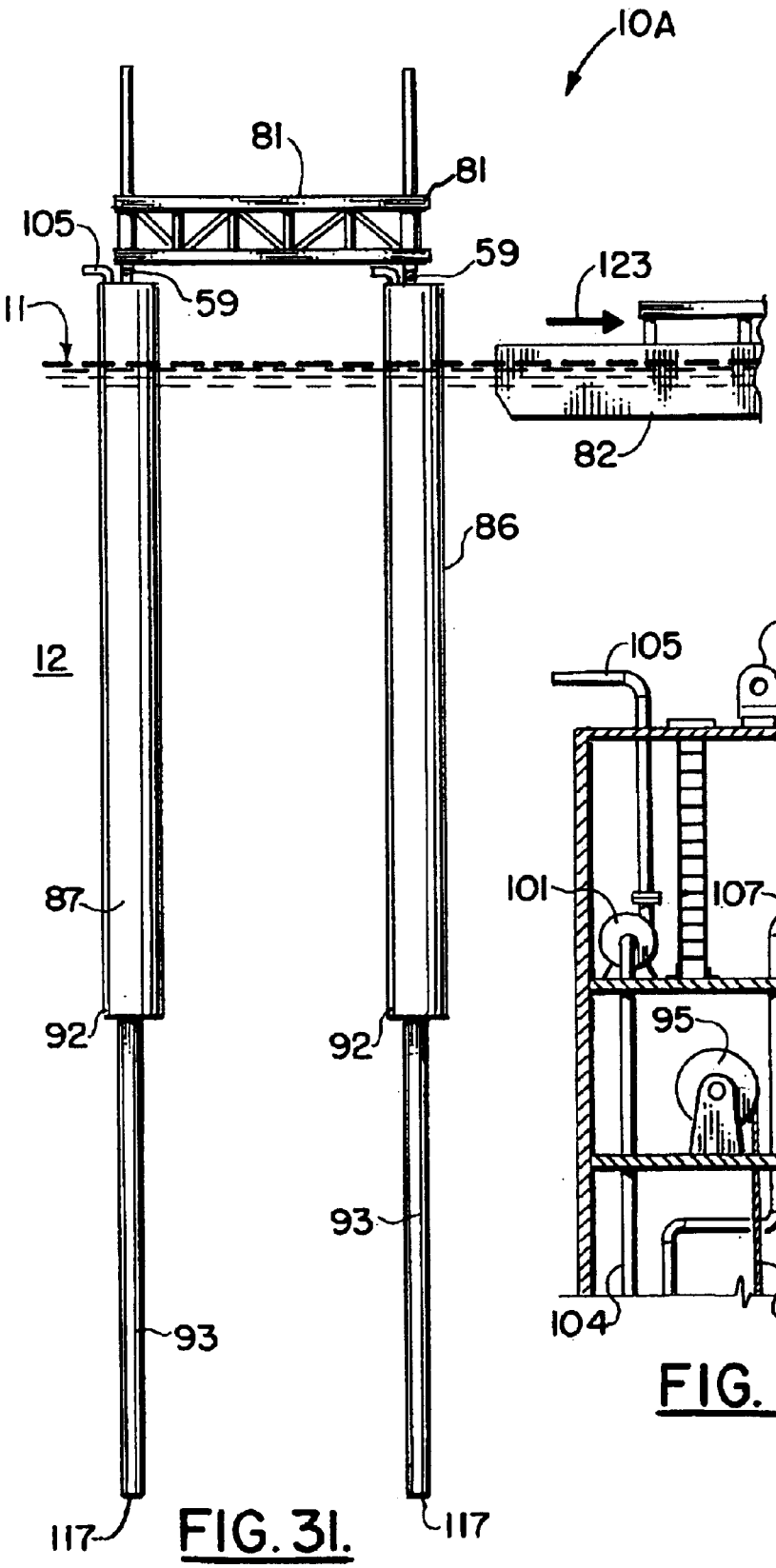
FIG. 31 is another elevation view illustrating an alternate method of the present invention.

Sleeve 112 provides a lower opening 113 that enables the counter weight 93 to be lowered beyond the lower end portion 92 of buoy 87. The counter weight 93 has a counter weight top 115 with a lifting eyelet 116 to which winch line 94 can be attached. Counter weight bottom 117 can extend well below the lower end portion 92 of buoy 87 or any one of the other buoys 86, 88, 89 as indicated in FIGS. 30 and 31.

Figure 27:
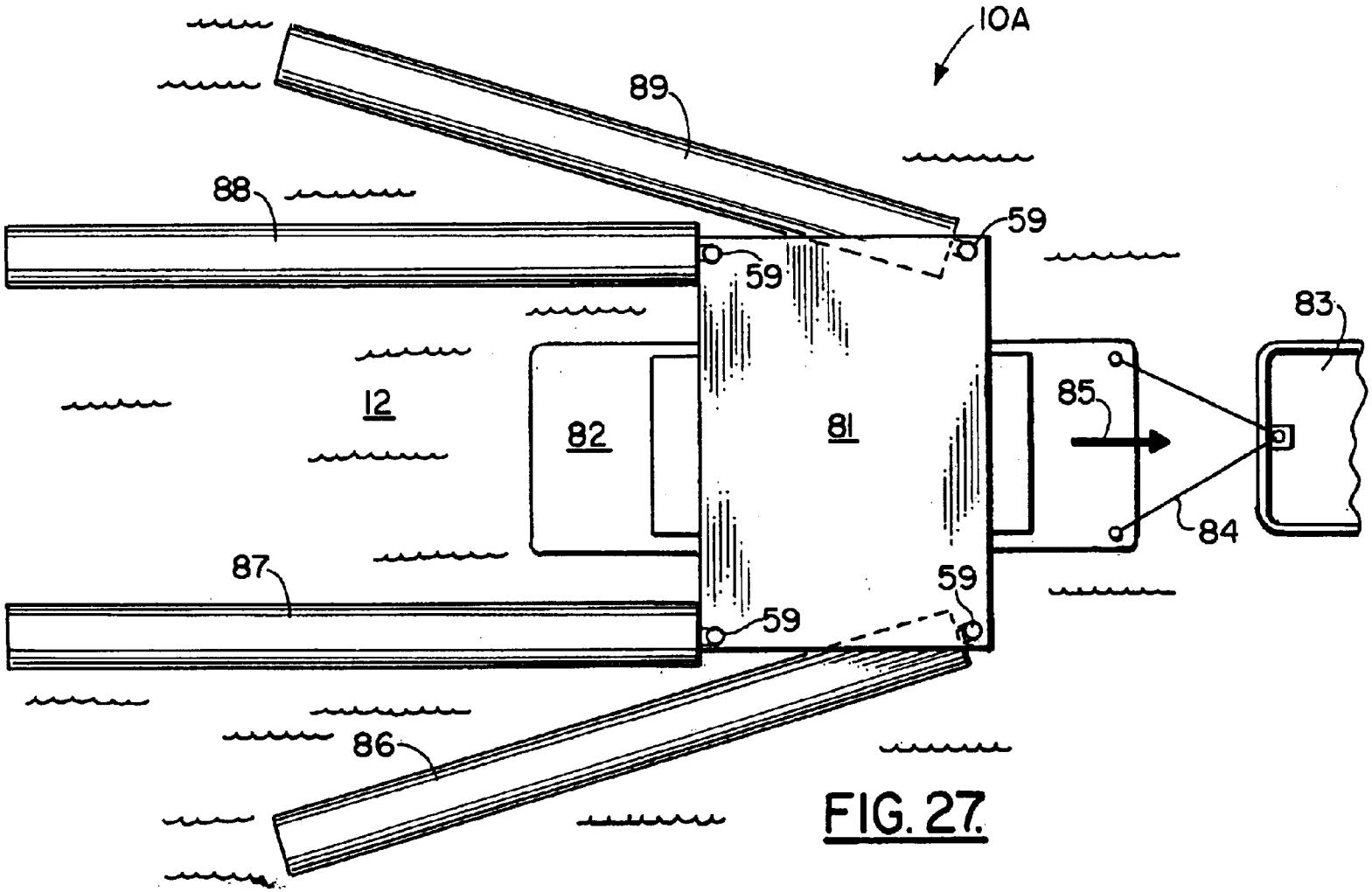
FIG. 27 is a plan view of the fifth embodiment and an alternate method of the present invention.

The alternate method of FIGS. 25–31 enables the platform 81 to be transported from an inshore shallow water location to a deep water location. The method and apparatus of the present invention that is shown in FIGS. 25–31 enables transport, from a customer's dock or other shallow water location that is much shallower than the length of any one of the buoys 86–89. FIGS. 26 and 27 show the initial assembly of platform 81, transport vessel 82, and buoys 86–89. As shown in FIG. 26, this initial configuration can be in a relatively shallow water lake, river or canal having a water depth of 123 that is as little as for example 10–20 feet deep or about that deep.

Towboat or tug 83 pulls the assembly of platform 81, transport vessel 82, and buoys 86–89 in the direction of arrow 85 to a location that is offshore.

Once in deep water, the buoys are moved from the generally horizontal or reclined position of FIGS. 26 and 27 to a diagonal position shown in FIG. 29 which is a transitional position.

The buoys 86–89 are almost empty of water during transport and are trimmed to assume a generally horizontal or nearly horizontal position. The ballast member or rod 93 assumes a first higher position to provide a first, higher center of gravity for each buoy 86–89. Upon arrival at a selected offshore, deep water location, the buoys 86–89 must be moved from a generally horizontal position or reclined position (of FIGS. 27, 28, 29) to an essentially vertical position (see FIG. 30). This is accomplished by ballasting, adding water to the buoys and/or moving ballast rod or ballast weight 93. Because of the weight of the ballast rod or ballast weight 93, the buoys 86–89 float lower in the water that would be the case if the buoys had no ballast weight or ballast rod 93 and even before being filled with water. This use of ballast rod or ballast weight 93 prevents excessive projection of the top of the buoy 86–89 above the water's surface that might cause high bending stresses in the buoy during upending as the buoys travel from the reclined or horizontal position of FIGS. 26–27 to the position in FIG. 29 to the essentially vertical position of FIG. 30. The ability to move the ballast member 93 in conjunction with fluid ballast (e.g. seawater) enables control of the center of rotation of each buoy 86–89 during upending. This also serves to reduce interface load between each of the buoys 86–89 and the platform 81 during upending (when the buoys 86–89 move from generally horizontal in FIG. 27 and 29 to generally vertical in FIG. 30.

In FIG. 29, pump 102 is pumping seawater via intake 104 and suction line 106 into buoy interior 110 as indicated schematically by arrows 118 in FIG. 29. As water accumulates at the lower end portion 92 of buoy 87, the buoy 87 begins to rotate about connection 59 in the direction of arrow 119 until it reaches an essentially vertical position as shown in FIG. 30. Because of wave action, the buoys 86–89 are not necessarily exactly vertical in FIGS. 30–31, but will tilt somewhat during the transfer of load of platform 81 from vessel 82 to buoys 86–89 and after such transfer. Thus "essentially vertical" or "substantially vertical" as used herein means erect and greatly inclined, as opposed to being perfectly 90 degrees with respect to water's surface 11, though it includes a condition wherein the buoys are perfectly vertical at 90 degrees with the water's surface 11, as might occur in perfectly calm water or sea state.

During the upending operation of FIG. 29, or upon reaching a generally vertical position as shown in FIG. 30, the buoy counter weights 93 can be lowered in the direction of arrows 120 to a position that places them well below the lower end portion 92 of the buoys 86–89. This configuration shown in FIG. 30 lowers the center of gravity of each of the buoys 86–89. Once this is accomplished, there is no longer a need for the all of the fluid that was pumped into the buoy interiors 110, so that it can now be removed from the buoy interiors 110 using pump 101. The pump 101 intakes seawater from buoy interior 110 via suction line 104 and discharges it to the surrounding ocean 12 via discharge flow line 105 as indicated schematically in FIG. 30 by arrows 122.

As seawater is discharged from the buoy interiors 110 for each of the buoys 86–89, the buoys 86–89 each float higher and higher with respect to water's surface 11, elevating platform 81 until it is no longer supported by transport vessel 82. In FIG. 30, the arrows 120 indicate schematically the lowering of counter weights 93 and the simultaneous elevating of buoys 86–89 as seawater is removed from them by pumping using pump 101. Transport vessel 82 can then be removed in the direction of arrow 123 so that the platform 81 is supported only by the plurality of buoys 86–89.

Platform 81 and vessel 82 could be a combined structure, so that when the buoys 86–89 are ballasted to the essentially vertical position of FIG. 30 and then upwardly as shown in FIG. 31, they then support the combined structure of platform 81 and vessel 82. In such a situation, the term platform as used herein means the combined structure that includes platform 81 and vessel 82.

PARTS LIST

| PART NUMBER | DESCRIPTION |
|---|---|
| 10 | floating marine platform apparatus |
| 10A | floating marine platform apparatus |
| 11 | water surface |
| 12 | ocean |
| 13 | buoy |
| 14 | buoy |
| 15 | buoy |

-continued

| PART NUMBER | DESCRIPTION |
|---|---|
| 16 | buoy |
| 17 | platform |
| 18 | upper horizontal member |
| 19 | lower horizontal member |
| 20 | vertical member |
| 21 | diagonal member |
| 22 | upper end portion |
| 23 | conical shape |
| 24 | attachment portion |
| 25 | convex surface |
| 26 | concave surface |
| 27 | connecting portion |
| 28 | central longitudinal axis |
| 29 | axis |
| 30 | internal reinforcing plate |
| 31 | upper padeye |
| 32 | mooring line |
| 33 | lower padeye |
| 34 | horizontal mooring line |
| 35 | internal reinforcing plate |
| 36 | upper curved plate |
| 37 | lower curved plate |
| 38 | conical plate |
| 39 | tensioned mooring line |
| 40 | padeye |
| 41 | caternary mooring line |
| 42 | buoy |
| 43 | cylindrical middle section |
| 44 | cylindrical lower section |
| 45 | square lower section |
| 46 | buoy |
| 47 | cylindrical middle section |
| 48 | conical upper section |
| 49 | trussed lower section |
| 50 | padeye |
| 51 | sea bed |
| 52 | anchor |
| 53 | drilling/production facility |
| 54 | pinned connection |
| 55 | pinned connection |
| 56 | pin |
| 57 | pin |
| 58 | opening |
| 59 | universal joint |
| 60 | water discharge |
| 61 | water level |
| 62 | buoy interior |
| 63 | arrow |
| 64 | end portion |
| 65 | end portion |
| 66 | spar |
| 67 | upper end portion |
| 68 | arrow |
| 69 | tow boat |
| 70 | tow line |
| 71 | attachment |
| 72 | arrow |
| 73 | barge |
| 74 | barge deck |
| 75 | bottom |
| 76 | port side |
| 77 | starboard side |
| 78 | bearing plate |
| 79 | bearing plate |
| 80 | directional arrows |
| 81 | platform |
| 82 | transport vessel |
| 83 | tugboat |
| 84 | tow line |
| 85 | arrow |
| 86 | buoy |
| 87 | buoy |
| 88 | buoy |
| 89 | buoy |
| 90 | outer wall |
| 91 | upper end portion |
| 92 | lower end portion |

-continued

| PART NUMBER | DESCRIPTION |
|---|---|
| 93 | ballast weight |
| 94 | lift line |
| 95 | winch |
| 96 | winch deck |
| 97 | upper deck |
| 98 | horizontal section |
| 99 | vertical section |
| 100 | diagonal section |
| 101 | pump |
| 102 | pump |
| 103 | pump deck |
| 104 | suction line |
| 105 | discharge line |
| 106 | suction line |
| 107 | discharge line |
| 108 | seawater intake opening |
| 109 | discharge outlet |
| 110 | buoy interior |
| 111 | baffle |
| 112 | sleeve |
| 113 | opening |
| 114 | arrow |
| 115 | counter weight top |
| 116 | lifting eyelet |
| 117 | counter weight bottom |
| 118 | arrow |
| 119 | arrow |
| 120 | arrow |
| 121 | arrow |
| 122 | arrow |
| 123 | arrow |

The foregoing embodiments are presented by way of example only; the scope of the present invention is to be limited only by the following claims.

What is claimed is:

1. A method of installing an offshore oil platform in deep water, comprising the steps of:

a) providing a vessel for floating a platform;

b) placing a platform on the vessel;

c) attaching a plurality of buoys to the platform, at an initial shallow water location that has a water depth that is less than the length of the longest of the buoys; each buoy being an elongated structure having upper and lower end portions, wherein the upper end portion of each buoy attaches to the platform with an articulating connection, wherein each buoy has a ballast member that can be moved relative to the buoy for changing the center of gravity of the buoy and wherein the buoys are not vertically positioned;

d) moving the assembly of vessel, platform and buoys to a deep water location that has a water depth that is greater than the length of the longest of the buoys;

e) ballasting the buoys from an essentially horizontal position to an essentially vertical position until they support the platform, wherein the ballast member is in a higher position relative to the buoy during transport and then in a lower position relative to the buoy when supporting the platform.

2. The method of claim 1 wherein the platform weighs between about 500 and 12,000 tons.

3. The method of claim 1 wherein each buoy has a diameter that is between about 10 and 150 feet.

4. The method of claim 1 wherein each buoy has a length that is between about 100 and 1200 feet.

5. The method of claim 2 wherein each buoy has a diameter that is between about 10 and 40 feet.

6. The method of claim 2 wherein each buoy has a length that is between about 100 and 600 feet.

7. The method of claim 3 wherein each buoy has a length that is between about 100 and 1200 feet.

8. The method of claim 4 wherein each buoy has a diameter that is between about 10 and 150 feet.

9. The method of claim 1 wherein the platform weighs between about 500 and 12,000 tons.

10. The method of claim 1 wherein each buoy has a diameter that is between about 10 and 150 feet.

11. The method of claim 1 wherein each buoy has a length that is between about 100 and 1200 feet.

12. The method of claim 2 wherein each buoy has a diameter that is between about 10 and 40 feet.

13. The method of claim 2 wherein each buoy has a length that is between about 100 and 600 feet.

14. The method of claim 3 wherein each buoy has a length that is between about 100 and 1200 feet.

15. The method of claim 4 wherein each buoy has a diameter that is between about 10 and 150 feet.

16. The method of claim 1 wherein the vessel in step "a" is a barge.

17. The method of claim 1 wherein in step "c" the shallow water location has a water depth of less than 50 feet.

18. The method of claim 1 wherein the deep water location has a water depth of more than 100 feet.

19. The method of claim 1, the buoys assume a generally reclined position in step "d".

20. The method of claim 1 wherein the buoys float at the water's surface in step "d".

21. The method of claim 1 further comprising changing the center of gravity of at least one of the buoys in step "d" or "e".

22. The method of claim 1 further comprising changing the center of gravity of at least one of the buoys in step "d" and "e".

23. The method of claim 1 wherein the platform weighs about 500 and 4000 tons.

24. The method of claim 1 wherein each buoy, has a diameter that is between about 10 and 40 feet.

25. The method of claim 1 wherein each buoy has a length that is between about 100 and 600 feet.

26. The method of claim 23 wherein each buoy has a diameter that is between about 10 and 40 feet.

27. The method of claim 23 wherein each buoy has a length that is between about 100 and 400 feet.

28. The method of claim 20 wherein each buoy has a diameter that is between about 10 and 40 feet.

29. The method of claim 26 wherein each buoy has a length that is between about 100 and 600 feet.

30. The method of claim 1 wherein the platform weighs about 4000 and 12,000 tons.

31. The method of claim 1 wherein each buoy has a diameter that is between about 25 and 75 feet.

32. The method of claim 1 wherein each buoy has a length that is between about 250 and 1000 feet.

33. The method of claim 30 wherein each buoy has a diameter that is between about 250 and 1000 feet.

34. The method of claim 30 wherein each buoy has a length that is between about 250 and 1000 feet.

35. The method of claim 31 wherein each buoy has a diameter that is between about 250 and 1000 feet.

36. The method of claim 30 wherein each buoy has a length that is between about 100 and 600 feet.

37. The method of claim 1 wherein the platform weighs over 12,000 tons.

38. The method of claim 1 wherein each buoy has a diameter that is between about 25 and 150 feet.

39. The method of claim 1 wherein each buoy has a length that is between about 400 and 1,200 feet.

40. The method of claim 37 wherein each buoy has a diameter that is between about 25 and 150 feet.

41. The method of claim 37 wherein each buoy has a length that is between about 400 and 1,200 feet.

42. The method of claim 39 wherein each buoy has a diameter that is between about 25 and 150 feet.

43. The method of claim 40 wherein each buoy has a length that is between about 100 and 600 feet.

44. A method of installing an oil and gas well drilling or production platform in an offshore deep water marine environment, comprising the steps of:

a) floating a platform into the deep water marine environment on a transport vessel, the platform having an oil and gas well drilling or production facility and a peripheral portion with buoys attached thereto and that includes a plurality of connecting positions, one connecting position for each buoy; and b) ballasting the platform and buoys relative to one another until each buoy connects with the platform and substantially all of the weight of the platform is supported by the buoys; and c) making articulating connections that connect each buoy to the platform at respective connecting positions, the plurality of articulating connections allowing for buoy motions induced by sea movement while reducing sea movement effect on the platform; and d) wherein the transport vessel, platform, and buoys travel from an initial location in shallow water that is less than one hundred feet deep to the deep water location that is more than one hundred feet deep.

45. The method of claim 44 further comprising the step of mooring each buoy with an anchor line.

46. The method of claim 44 wherein each of the articulating connections includes correspondingly concave and convex engaging portions.

47. The marine platform of claim 44 wherein the buoy has a convex articulating portion and the platform has a concave articulating portion and in step "c" the barge and buoys are ballasted until concave and convex portions engage for each buoy and the platform.

48. The marine platform of claim 44 wherein the buoy has a concave articulating portion and the platform has a convex articulating portion.

49. The method of claim 44 wherein each buoy has a height and a diameter, the height being greater than the diameter, and further comprising the step of positioning the barge in between at least two buoys.

50. The method of claim 44 wherein there are at least three buoys and at least three attachment positions.

51. The method of claim 44 wherein there are at least four buoys.

52. The method of claim 44 wherein the platform is comprised of a trussed deck and wherein steps "b" and "c" include connecting each buoy to the trussed deck.

53. The method of claim 44 further comprising the steps of providing a single spar and transferring the platform from the buoys to the single spar.

54. A method of installing an oil and gas well production platform in an offshore deep water marine environment, comprising the steps of:

a) floating a multi-ton package to a selected offshore location with a vessel, the package having a plurality of connectors and wherein the connectors are preliminarily positioned at a higher elevational position;

b) connecting a plurality of elongated floating buoys to the package, each buoy having a length between upper and lower end portions, each buoy having a buoy connector portion at its upper end portion;

c) moving the vessel platform and buoys from a shallow water location having a water depth that is a smaller dimension than the length of one of the buoys to a deep water location that is a greater dimension than the length of one of the buoys;

d) ballasting the floating package and buoys relative to one another so that the package is supported by the buoys;

e) using articulating connections to transfer load between the package and the buoys; and f) wherein the buoys are not vertically positioned in step "c" and generally vertically positioned in step "d".

55. The method of claim 54 wherein step "a" comprises floating a multi-ton package to a selected offshore location, the package having an oil and gas well drilling facility thereon and a plurality of connectors, and wherein the buoys are positioned in a horizontal or near horizontal position.

56. The method of claim 54 wherein in step "d", the buoys are ballasted from a higher elevational position to a lower elevational position.

57. The method of claim 54 wherein in step "d" the buoys are ballasted from a position that forms a smaller angle with the water's surface to a position that forms a greater angle with the water's surface.

58. The method of claim 54 wherein in step "a" the vessel is a barge having a deck that supports the multi-ton package and step "a" includes floating the multi-ton package barge to a selected offshore location with the buoys attached to the combination of package and barge for at least part of travel time to the offshore location.

59. The method of claim 54 wherein in step "d", the articulating connections each include correspondingly shaped concave and convex portions.

60. The method of claim 54 wherein the articulating connections include universal joint connections.

61. The method of claim 54 wherein in steps "a" through "c", the floating package has a periphery and the buoys are spaced about the periphery of the package.

62. A method of installing an oil and gas well production platform in an offshore deep water marine environment, comprising the steps of:

a) floating a multi-ton package and vessel to a selected offshore location, the package having a plurality of connectors;

b) connecting a plurality of floating buoys to the platform and vessel assembly, each buoy having a buoy connector portion at its upper end;

c) ballasting buoys relative to the package and vessel so that the package and vessel separate at least one articulating connector for each floating buoy defining an interface between a buoy and the package.

63. The method of claim 62 further comprising the step of ballasting the buoys by initially adding ballast to the buoys until they are substantially vertically overted and then removing ballast from the buoys so that the buoys elevate the package from the vessel.

64. The method of claim 62 further comprising the step of making articulating connections that connect each buoy to the platform at respective connecting positions, the plurality of articulating connections allowing for buoy motions induced by sea movement while reducing sea movement effect on the platform.

65. The method of claim 62 wherein each of the articulating connections includes correspondingly concave and convex engaging portions.

66. The marine platform of claim 62 wherein the buoy has a convex articulating portion and the platform has a concave articulating portion and in step "c" the barge and buoys are ballasted until concave and convex portions engage for each buoy and the platform.

67. The marine platform of claim 62 wherein the buoy has a concave articulating portion and the platform has a convex articulating portion.

68. The method of claim 62 wherein each buoy has a height and a diameter, the height being greater than the diameter.

69. The method of claim 62 wherein the platform is comprised of a trussed deck and wherein step "c" includes connecting each buoy to the trussed deck.

70. A method of installing an oil and gas well production platform in an offshore deep water marine environment, comprising the steps of:

a) floating a vessel with a multi-ton package to a selected offshore location, the package having a plurality of connectors;

b) attaching a buoy to each connector;

c) positioning the buoys in a reclined position during steps "a" and "b";

d) transferring the package load from the vessel to the buoys by ballasting the buoys;

e) wherein the buoys are initially weighed by adding ballast until they are generally vertically positioned; and f) wherein the buoys and vessel are relative to each other so that platform load is transferred from the vessel to the buoys.

71. A method of installing an offshore oil platform in deep water, comprising the steps of:

a) providing a vessel for floating a platform;

b) placing a platform on the vessel;

c) attaching a plurality of buoys to the platform at an initial shallow water location that has a water depth that is less than the length of the longest of the buoys; each buoy being an elongated structure having upper and lower end portions, wherein the upper end portion of each buoy attaches to the platform with an articulating connection;

d) moving the assembly of vessel, platform and buoys to a deep water location that has a water depth that is greater than the length of the longest of the buoys; and e) ballasting the buoys until they support the platform.

72. The method of claim 71 wherein at least a plurality of the buoys have ballast members that are movable relative to the buoy and during step "e" the ballast member of at least one of the buoys is moved relative to the buoy.

* * * * *